US011346352B2

(12) United States Patent
Liu et al.

(10) Patent No.: US 11,346,352 B2
(45) Date of Patent: May 31, 2022

(54) GARDEN BLOWER

(71) Applicant: Positec Power Tools (Suzhou) Co., Ltd., Jiangsu (CN)

(72) Inventors: Zhengwei Liu, Jiangsu (CN); Shiping Jiao, Jiangsu (CN); Jiabo Liu, Jiangsu (CN); Xuefeng Yu, Jiangsu (CN); Ka Tat Kelvin Wong, Jiangsu (CN); Xiahong Zha, Jiangsu (CN); Fengli Zhao, Jiangsu (CN)

(73) Assignee: POSITEC POWER TOOLS (SUZHOU) CO., LTD., Jiangsu (CN)

( * ) Notice: Subject to any disclaimer, the term of this patent is extended or adjusted under 35 U.S.C. 154(b) by 501 days.

(21) Appl. No.: 16/270,372

(22) Filed: Feb. 7, 2019

(65) Prior Publication Data

US 2019/0211830 A1 Jul. 11, 2019

Related U.S. Application Data

(63) Continuation of application No. PCT/CN2017/096853, filed on Aug. 10, 2017.

(30) Foreign Application Priority Data

| | | |
|---|---|---|
| Aug. 10, 2016 | (CN) | 201610651822.5 |
| Nov. 29, 2016 | (CN) | 201621294961.9 |
| Apr. 26, 2017 | (CN) | 201710282926.8 |

(51) Int. Cl.

| | |
|---|---|
| ***F04D 19/00*** | (2006.01) |
| ***F04D 25/08*** | (2006.01) |
| ***E01H 1/08*** | (2006.01) |

(52) U.S. Cl.

CPC ..... *F04D 25/08* (2013.01); *E01H 1/08* (2013.01); *E01H 1/0809* (2013.01); *F04D 19/007* (2013.01)

(58) Field of Classification Search

CPC ..... A01G 20/47; A01G 20/00; A01G 20/43; E01H 1/0809; F04D 19/007;

(Continued)

(56) References Cited

U.S. PATENT DOCUMENTS 5,203,164 A * 4/1993 Paulson ..... F02K 1/34 181/220
5,841,943 A * 11/1998 Nosenchuck ..... A45D 20/10 392/385

(Continued)

FOREIGN PATENT DOCUMENTS

AU 733030 B2 11/1998
AU 7162298 A 11/1998

(Continued)

OTHER PUBLICATIONS

State Intellectual Property Office of the P.R. China, International Search Report and Written Opinion (English translation included) for International Application No. PCT/CN2017/096853 dated Oct. 17, 2017.

*Primary Examiner* — Kenneth J Hansen
*Assistant Examiner* — Thomas Fink
(74) *Attorney, Agent, or Firm* — Middleton Reutlinger

(57) ABSTRACT

The embodiments relates to garden blower, including: an enclosure, including a main body part located on back end and a blowing pipe located on front end and extending axially, the enclosure disposed with an air inlet and an air outlet communicated with external environment; a power device, connected to the enclosure; a fan component, driven by the power device and generating airflows; the fan component includes at least two-level fans, further includes a first-level fan and a second-level fan axially disposed front and back, the garden blower includes a first air inlet passage allowing entrance of the airflows generated by the first-level fan and a second air inlet passage allowing entrance of the (Continued)

airflows generated by the second-level fan, and the airflows entering the first air inlet passage and the airflows entering the second air inlet passage are converged into the blowing pipe and are blown to the outside.

11 Claims, 13 Drawing Sheets

(58) Field of Classification Search
CPC ..... F04D 19/028; F04D 25/08; F04D 25/082; F04D 25/166; F04D 25/06; F04D 25/064; F04D 29/327; F04D 29/522; F04D 29/545; F04D 29/547; F04D 29/526
See application file for complete search history.

(56) References Cited

U.S. PATENT DOCUMENTS

| | | | | |
|---|---|---|---|---|
| 6,011,903 | A | 1/2000 | Nosenchuck | |
| 7,445,423 | B2 | 11/2008 | Ishihara et al. | |
| 7,739,773 | B2 | 6/2010 | Schliemann et al. | |
| 7,896,612 | B2 | 3/2011 | Schliemann et al. | |
| 7,909,568 | B2 | 3/2011 | Ishihara et al. | |
| 8,936,434 | B2 | 1/2015 | Peterson et al. | |
| 2002/0094280 | A1* | 7/2002 | Lin | F04D 19/007 417/286 |
| 2007/0059155 | A1 | 3/2007 | Ishihara et al. | |
| 2008/0089785 | A1* | 4/2008 | Schliemann | F04D 25/02 415/208.1 |
| 2008/0124232 | A1* | 5/2008 | Lee | F04D 19/007 417/423.5 |
| 2008/0138199 | A1* | 6/2008 | Chang | F04D 29/325 415/199.5 |
| 2008/0189904 | A1 | 8/2008 | Schliemann et al. | |
| 2009/0047118 | A1 | 2/2009 | Ishihara et al. | |
| 2012/0076672 | A1* | 3/2012 | Binder | F04D 25/064 417/234 |
| 2012/0201668 | A1 | 8/2012 | Peterson et al. | |
| 2014/0050600 | A1* | 2/2014 | Kodato | F04D 29/541 417/360 |
| 2014/0079536 | A1* | 3/2014 | Chen | F04D 19/002 415/115 |
| 2016/0324380 | A1* | 11/2016 | Sergyeyenko | A01G 20/47 |
| 2017/0089595 | A1* | 3/2017 | Su | F24F 3/16 |
| 2017/0102007 | A1* | 4/2017 | Stauter | F24F 1/50 |
| 2018/0087513 | A1* | 3/2018 | Hoffman | F04D 19/02 |
| 2018/0146628 | A1* | 5/2018 | Huo | A01G 20/47 |
| 2019/0345947 | A1* | 11/2019 | Yao | F04D 29/38 |
| 2020/0378404 | A1* | 12/2020 | Fukunaga | F04D 19/002 |
| 2021/0199119 | A1* | 7/2021 | Guo | F04D 27/004 |

FOREIGN PATENT DOCUMENTS

| | | | |
|---|---|---|---|
| CA | 2287311 | A1 | 11/1998 |
| CN | 1253614 | A | 5/2000 |
| CN | 1971065 | A | 5/2007 |
| CN | 101120866 | A | 2/2008 |
| CN | 101125072 | B | 12/2011 |
| CN | 105648959 | A | 6/2016 |
| CN | 105648960 | A | 6/2016 |
| CN | 105648961 | A | 6/2016 |
| CN | 105648962 | A | 6/2016 |
| CN | 105648963 | A | 6/2016 |
| CN | 105648964 | A | 6/2016 |
| CN | 205934814 | U | 2/2017 |
| CN | 205999837 | U | 3/2017 |
| CN | 206280276 | U | 6/2017 |
| DE | 6020060020813 | | 9/2018 |
| EP | 0980499 | A1 | 2/2000 |
| EP | 1764511 | A1 | 3/2007 |
| HK | 1103781 | A1 | 1/2011 |
| JP | 2001526563 | A | 12/2001 |
| JP | 2007077890 | A | 3/2007 |
| JP | 2008095701 | A | 4/2008 |
| JP | 4128194 | B2 | 7/2008 |
| JP | 4871303 | B2 | 2/2012 |
| JP | 2013113206 | A | 6/2013 |
| TW | 200730734 | A | 8/2007 |
| TW | 402427 | | 7/2013 |
| WO | 9849500 | A1 | 11/1998 |
| WO | 2016082799 | A1 | 6/2016 |

* cited by examiner

GARDEN BLOWER

BACKGROUND

Technical Field

The present embodiments relates to a garden blower, and in particular to a fan and an air inlet passage of the garden blower.

Related Art

With continues expansion of an urban green area, the green belts of parks, roads and public occasions are all over the place, and a lawn trimming tool is also widely applied. Wherein the blower belongs to a conventional electric tool, and is mainly used for blowing falling leaves, dust and accumulated water and snow on the roads and forest fire fighting. In the use process of the blower, the user has different requirements on wind power and wind volume under different use environments. There also exist various adjusting modes on the wind power and wind volume in prior art, generally, multilevel fans of the same structure are serially connected to increase the wind power, or the area of an air inlet is increased to improve the wind volume.

For example, CN patent CN205934814U discloses a handheld axial flow blower, comprising an upper shell, an air outlet cylinder, a motor, ducts and a lower shell, wherein the motor is disposed in the middle of the upper shell and configured to drive the fans to rotate, the lower end of the motor is connected to the lower shell, a plurality of detachable ducts are disposed between the upper shell and the lower shell, the fans in the ducts are connected to the motor, a plurality of bosses a are disposed on the periphery of the side surface of the lower shell, and the upper end of the inner wall of the air outlet cylinder is provided with a plurality of L-shaped grooves corresponding to the bosses a and configured to connect the air outlet cylinder to the lower shell. The handheld axial flow blower adopts a multilevel fan design, a level number of the fans can be increased or reduced according to different needs to correspond to different wind volume specifications, there is no need to manufacture a new mould, the use scenarios are greatly expanded, and not only is the blower suitable for blowing garbage, turfgrass clippings and falling leaves as on the lawn as well as the falling leaves of the parks and the roads, but also the strong wind power can be used for the forest fire fighting, road sweeping and snow blowing operation.

In the above patent document, since the structure and number of all levels of fans are consistent, the conditions that the wet leaves cannot be moved by blowing and the blowing efficiency is low exist when in use, an optimal blowing effect cannot be achieved and the use of a user is affected.

SUMMARY

Therefore, the problem to be solved by the present embodiments is to provide a garden blower, whose blowing efficiency is effectively improved.

The technical solution adopted by the present embodiments to solve the prior art problems is:

A garden blower, comprising: an enclosure, comprising a main body part located on a back end and a blowing pipe located on a front end of the main body part and extending axially, the enclosure being further disposed with an air inlet and an air outlet communicated with an external environment; a power device, connected to the enclosure to provide power for the garden blower; a fan component, driven by the power device to rotate and generating airflows; the fan component comprises at least two-level fans, the at least two-level fans comprise a first-level fan and a second-level fan axially disposed front and back, the garden blower comprises a first air inlet passage allowing entrance of the airflows generated by the first-level fan and a second air inlet passage allowing entrance of the airflows generated by the second-level fan, and the airflows entering the first air inlet passage and the airflows entering the second air inlet passage are converged into the blowing pipe and are blown to the outside from the air outlet.

Further, the first-level fan is disposed further away from the air outlet compared with the second-level fan, and a sectional area of the first-level fan in a radial direction is smaller than a sectional area of the second-level fan in a radial direction.

Further, the air inlet comprises a first group of air inlets introducing the airflows into the blowing pipe, when the garden blower is in a working state, the airflows enter the blowing pipe from the first group of air inlets, and the above first air inlet passage is formed between the first group of air inlets and the first-level fan.

Further, the first group of air inlets comprise an axial air inlet formed in the main body part and a radial air inlet annularly disposed in the main body part in a peripheral direction.

Further, the air inlet further comprises a second group of air inlets allowing the airflows to enter the blowing pipe, when the garden blower is in a working state, the airflows enter the blowing pipe from the second group of air inlets, and the above second air inlet passage is formed between the second group of air inlets and the second-level fan.

Further, the first group of air inlets and the second group of air inlets are axially separated front and back.

Further, the first group of air inlets and the second group of air inlets are both located in a back side of the fan component.

Further, in a direction vertical to the axial direction, at least part of a region of the second air inlet passage is annularly disposed on the periphery of at least part of a region of the first air inlet passage.

Further, the air flows entering the first air inlet passage are generated by common driving of the first-level fan and the second-level fan, and the airflows entering the second air inlet passage are generated by single driving of the second-level fan.

Further, the enclosure further comprises a first duct part guiding the airflows into the blowing pipe, and when the garden blower is in the working state, the airflows entering from the first group of air inlets flow into the blowing pipe from the first duct part.

Further, the first-level fan is disposed in the first duct part, and at least part of a region of the first air inlet passage is formed in an inner cavity defined by the first duct part.

Further, the first duct part comprises a first interface part penetrating in the axial direction and a second interface part opposite to the first interface part, the first interface part is communicated with the first group of air inlets, the second interface part is disposed between the first-level fan and the second-level fan, and a sectional area of the second interface part in a radial direction is smaller than a sectional area of the second-level fan in a radial direction.

Further, the enclosure further comprises a second duct part guiding the airflows into the blowing pipe, and when the garden blower is in the working state, the airflows entering from the second group of air inlets flow into the blowing pipe from the second duct part.

Further, the second-level fan is disposed in the second duct part, and at least part of a region of the second air inlet passage is formed between an inner wall of the second duct part and an outer wall of the first duct part.

Further, a front end of the first duct part and the second-level fan are axially disposed with an interval.

Further, at least part of the airflows entering the first air inlet passage and at least part of the airflows entering the second air inlet passage are converged between the first-level fan and the second-level fan, and blown into the blowing pipe from the second-level fan.

Further, the first-level fan and the second-level fan comprise a hub and a plurality of blades disposed around the hub in a peripheral direction, and at least one of the number of the blades, a rotary outer diameter of the blades and a rotary inner diameter of the blades of the first-level fan is different from the number of the blades, a rotary outer diameter of the blades and a rotary inner diameter of the blades of the corresponding second-level fan.

Further, the absolute value range of a difference value between the rotary outer diameter of the first-level fan and the rotary outer diameter of the second-level fan is 10 mm-90 mm.

Further, a difference value absolute value between the rotary inner diameter of the blades of the first-level fan and the rotary inner diameter of the blades of the second-level fan is smaller than or equal to 50 mm.

Further, a hub ratio of the first-level fan is 0.55-0.85, and a hub ratio of the second-level fan is 0.5-0.8.

Further, the difference between the number of the blades of the first-level fan and the number of the blades of the second-level fan is 1-9.

Further, the garden blower comprises a first-level guide blade corresponding to the first-level fan and a second-level guide blade corresponding to the second-level fan, the first-level fan and the second-level fan both have an air inlet side and an air outlet side, the first-level guide blade is located on the air outlet side of the first-level fan and the second-level guide blade is located on the air outlet side of the second-level fan.

Further, a preset clearance exists between the first-level fan and the first-level guide blade and between the second-level fan and the second-level guide blade, and a size range of the preset clearance in an axial direction is 3 mm-12 mm.

Further, when the garden blower is in the working state, a wind speed of the garden blower is 50-150 mph, and a wind volume of the garden blower is 250-800 cfm.

Further, the power device comprises a motor and a control circuit, the motor controls rotational motion of the fan component, a rotary speed of the motor is larger than or equal to 8000 revolutions/min and smaller than or equal to 25000 revolutions/min, a rotary outer diameter of the first-level fan is 40 mm-80 mm, and a rotary outer diameter of the second-level fan is 70 mm-130 mm.

Further, the power device comprises a motor and a control circuit, the motor controls rotational motion of the fan component, a rotary speed of the motor is larger than or equal to 25000 revolutions/min and smaller than or equal to 100000 revolutions/min, a rotary outer diameter of the first-level fan is 20 mm-50 mm, and a rotary outer diameter of the second-level fan is 30 mm-70 mm.

Further, the blowing pipe is disposed with a central axis axially, the motor drives the first-level fan and the second-level fan to rotate around a rotational axis, the first-level fan and the second-level fan are coaxially disposed and have a rotary axis driven by the motor to rotate, and the central axis of the blowing pipe, the rotational axis of the motor and the rotary axis of the first-level fan and the second-level fan are coincided.

Further, the number of the first-level fan is larger than or equal to 1, and the number of the second-level fan is larger than or equal to 1.

Further, the first-level fan and the second-level fan are both an axial flow fan.

Further, the at least two-level fans comprise a third level fan, and the number of the blades or a rotary outer diameter of the blades or a rotary inner diameter of the blades of at least one level fan in the first-level fan, the second-level fan and the third level fan are different from the other two-level fans.

Therefore, the problem to be solved by the present embodiments is to provide a garden blower, whose blowing efficiency is effectively improved.

The technical solution adopted by the present embodiments to solve the prior art problems is:

A garden blower, comprising: an enclosure, comprising a main body part located on a back end and a blowing pipe located on a front end of the main body part and extending axially, the enclosure being further disposed with an air inlet and an air outlet communicated with an external environment; a power device, connected to the enclosure to provide power for the garden blower; a fan component, driven by the power device to rotate and generating airflows; the fan component comprises at least two-level fans, the at least two-level fans comprise a first-level fan and a second-level fan axially disposed front and back, the first-level fan and the second-level fan both comprise a hub and a plurality of blades disposed around the hub in a peripheral direction, and at least one of a rotary outer diameter of the blades, a rotary inner diameter of the blades, the number of the blade and a dip angle of the blades of the first-level fan is different from the second-level fan.

Further, the first-level fan is disposed further away from the air outlet compared with the second-level fan, and the first-level fan and the second-level fan are both of an axial flow fan.

Further, the power device can drive the first-level fan and the second-level fan to rotate, at least part of the airflows generated by rotation of the first-level fan and the second-level fan enters the blowing pipe from the air inlet, and an independent air inlet passage is formed between the air inlet and the air outlet.

Further, a ratio range between a shaft power of the first-level fan and a shaft power of the second-level fan is 1.05:1-2.5:1.

Further, the blades of the first-level fan rotate to form a first annular rotary surface, the blades of the second-level fan rotate to form a second annular rotary surface, and a sectional area of the second annular rotary surface in a radial direction is smaller than a sectional area of the first annular rotary surface in a radial direction.

Further, a clearance between edges of the blades of the first-level fan and an inner wall of the enclosure of the first-level fan is larger than or equal to a clearance between edges of the blades of the second-level fan and an inner wall of the enclosure of the second-level fan.

Further, the air inlet comprises a first group of air inlets introducing the airflows into the blowing pipe, when the garden blower is in a working state, the airflows enter the blowing pipe from the first group of air inlets, and the above first air inlet passage is formed between the first group of air inlets and the first-level fan.

Further, the first groups of air inlets comprise an axial air inlet formed in the main body part and a radial air inlet annularly disposed in the main body part in a peripheral direction.

Further, the air inlet further comprises a second group of air inlets introducing the airflows into the blowing pipe, when the garden blower is in a working state, the airflows enter the blowing pipe from the second group of air inlets, and the above second air inlet passage is formed between the second group of air inlets and the second-level fan.

Further, at least part of the airflows entering the first air inlet passage and at least part of the airflows entering the second air inlet passage are converged between the first-level fan and the second-level fan, and blown into the blowing pipe from the second-level fan.

Further, the first group of air inlets and the second group of air inlets are axially separated front and back.

Further, the blades of the first-level fan rotate to form a first annular rotary surface, the blades of the second-level fan rotate to form a second annular rotary surface, and a sectional area of the second annular rotary surface in a radial direction is larger than a sectional area of the first annular rotary surface in a radial direction.

Further, a hub ratio of the first-level fan is 0.55-0.85.

Further, a hub ratio of the second-level fan is 0.5-0.8.

Further, a dip angle of the first-level fan is different from a dip angle of the second-level fan.

Further, the difference between the number of the blades of the first-level fan and the number of the blades of the second-level fan is 1-9.

Further, the absolute value range of a difference value between the rotary outer diameter of the blades of the first-level fan and the rotary outer diameter of the blades of the second-level fan is 10 mm-90 mm.

Further, a difference value absolute value between the rotary inner diameter of the blades of the first-level fan and the rotary inner diameter of the blades of the second-level fan is smaller than or equal to 50 mm.

Further, the garden blower comprises a first-level guide blade corresponding to the first-level fan and a second-level guide blade corresponding to the second-level fan, the first-level fan and the second-level fan both have an air inlet side and an air outlet side, the first-level guide blade is located on the air outlet side of the first-level fan and the second-level guide blade is located on the air outlet side of the second-level fan.

Further, a preset clearance exists between the first-level fan and the first-level guide blade and between the second-level fan and the second-level guide blade, and a size range of the preset clearance in an axial direction is 3 mm-12 mm.

Further, the power device comprises a motor and a control circuit, the motor controls rotational motion of the fan component, and the power device and the enclosure are detachably mounted.

Further, the blowing pipe is disposed with a central axis axially, the first-level fan and the second-level fan are coaxially disposed and have a rotary axis driven by the motor to rotate, the motor drives the first-level fan and the second-level fan to rotate around a rotational axis, and the central axis of the blowing pipe, the rotational axis of the motor and the rotary axis of the first-level fan and the second-level fan are coincided.

BRIEF DESCRIPTION OF THE DRAWINGS

In order to clarify the specific embodiments of the present embodiments or the technical solution in prior art, the drawings used in the description on the specific embodiments or the prior art will be briefly introduced, and it is obvious that the drawings described below are some embodiments of the present embodiments, and those skilled in the art could obtain other drawings according these drawings without paying creative labor.

DETAILED DESCRIPTION

Figure 1:
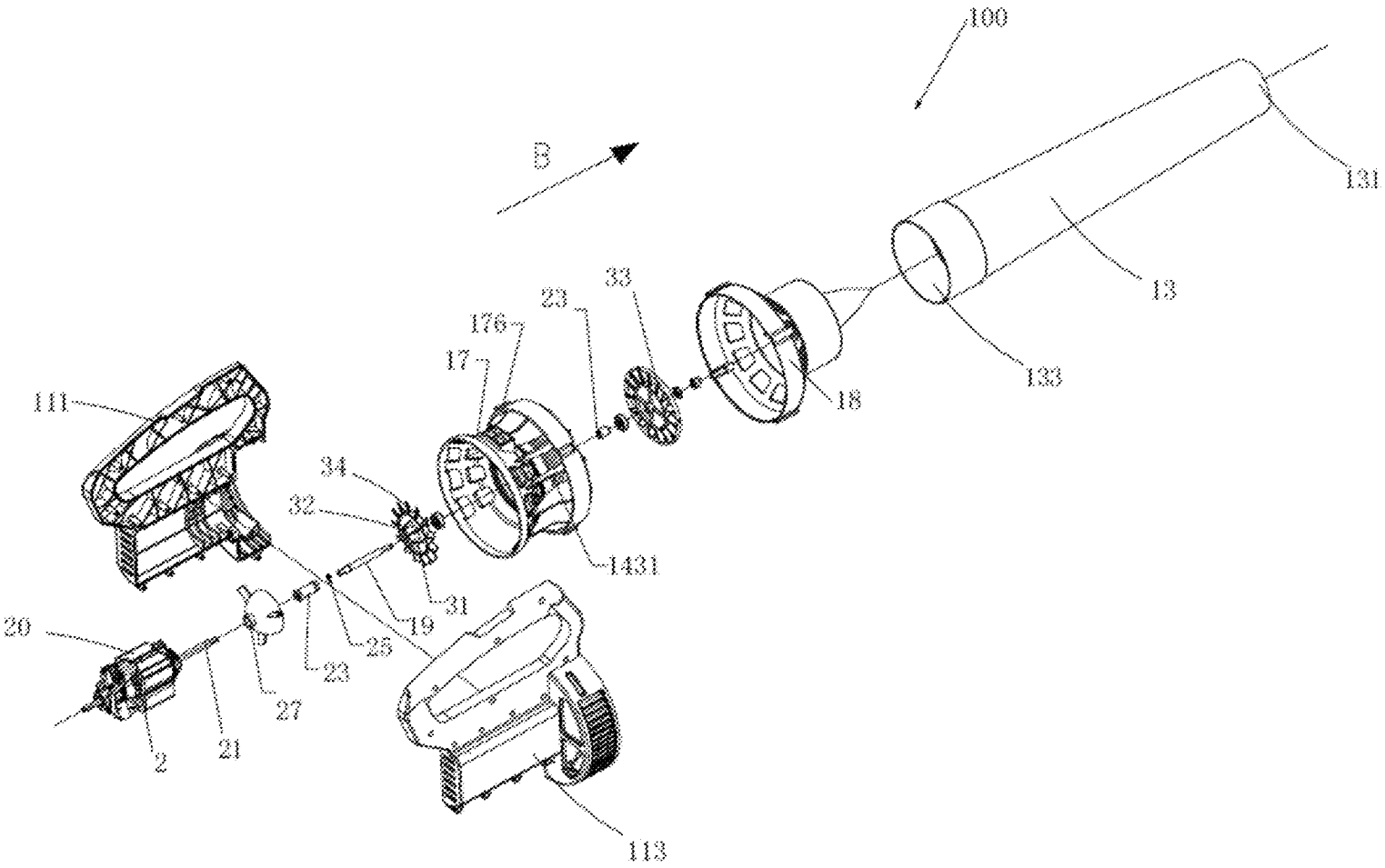
FIG. 1 is an exploded view of a two-level fan dual-air inlet passage garden blower according to a first embodiment of the present embodiments.

FIGS. 1 to 14 show structural schematic diagrams of garden blowers 100,100' disclosed by the present embodiments, and the garden blowers 100,100' are common garden tools and used for executing cleaning work. The garden blowers 100,100' mainly use a blowing function to collect scattered leaves, thereby achieving the purpose of cleaning. In the present embodiments, the garden blower can be understood as a single-blowing garden blower, and can also be understood as a blowing and sucking machine having both a blowing function and an air sucking function. The garden blowers 100,100' integrally extend along a direction as shown by an arrow B in FIG. 1 and such direction is defined as the axial direction.

As shown in FIGS. 1-4 and FIGS. 11-14, the garden blower comprises an enclosure 10, a power device 20 and a fan component 30. Wherein the enclosure 10 comprises a main body part 11 located on a back end and a blowing pipe 13 located on a front end and extending axially, as well as an air inlet 14 and an air outlet 131 communicated with an external environment and an inner cavity of the blowing pipe 13. The enclosure 10 can play a role of protection, and the fan component 30 and the power deice 20 are both mounted in the enclosure 10, thereby ensuring operation safety when a user uses the garden blower 100, and avoiding the contact with the fan component 30 or other parts.

The power device 20 is connected to the main body part 11 to provide power for the garden blower 100. The power device 20 comprises a motor 2 capable of diving the fan component 30 to rotate around a rotational axis, and the motor 2 is contained in the main body part 11. Of course, in other embodiments, the power device 20 is detachably connected to the enclosure 10, such that when the garden blower 100 is idle, the power device 20 can be detached to be used for other electric tools, and resource waste can be reduced.

The blowing pipe 13 approximately extends along a central axis X, and is hollow internally, configured to provide air circulation, and convenient for blowing the air to a boundary from the blowing pipe 13. It is defined that the blowing pipe 13 is located on the axial front end of the main body part 11, and then the other end opposite to the axial front end can be understood as the axial back end. The blowing pipe 13 comprises a connecting port 133 located in the axial back end, and the above air outlet 131 is located in the axial front end of the blowing pipe 13. The power device 20 drives the fan component 30 to rotate to introduce external airflows into the blowing pipe 13 and the external airflows are outward blown from the air outlet 131 of the blowing pipe 13. In the present embodiments, there is only one blowing pipe 13. Of course, in other embodiments, the blowing pipe 13 can be formed by combining a plurality of pipes and having a complete blowing function.

As shown in FIGS. 1-4 and 11-14, the fan component 30 is contained in the enclosure 10 and comprises at least two-level fans, and the at least two-level fans comprise a first-level fan 31 and a second-level fan 33 axially disposed front and back. The first-level fan 31 and the second-level fan 33 are coaxially disposed and have a rotary axis driven by the motor 2 to rotate. In the present embodiments, the rotational axis of the motor 2, the central axis X of the blowing pipe, and the rotary axis of the first-level fan 31 and the second-level fan 33 are coincided, relative to a single-level fan, the arrangement of the multilevel fans will bring about a design limitation of higher noise, while the noise of the whole set can be greatly reduced by coinciding the above three axes, and the blowing efficiency is better. Further, the first-level fan 31 and the second-level fan 33 are both an axial flow fan. Since the axial flow fan can generate higher wind speed, the blowing efficiency can be greatly improved without increasing a size of the fans.

According to the understanding of the those skilled in the art, a working effect of the garden blower mainly depends on a blowing volume and a blowing speed of the garden blower 100, the blowing volume and the blowing speed of the garden blower are mainly decided by a blowing effect of the fan component 30 as well as structures of the enclosure 10 and the blowing pipe 13, while the blowing effect of the fan component 30 is mainly decided by wind pressures and wind volumes of the at least two-level fans. The wind volume of the fan component 30 is the air volume discharged by the fan component in unit time. The wind pressure of the fan component 30 is a difference between the total pressure of outlet airflows and the total pressure of inlet airflows of the fan component 30.

For the current dual-level or multilevel single-blowing blower, the single-blowing blower usually adopts the fans of the same structure to act on the air to achieve the purpose of high wind pressure. However, after research and test, the inventors found that the structures of all levels of fans are the same, the shaft power of two-level or multilevel fans is close, and the pressurizing of the inter-level fans is close relatively, as a result, the multilevel fans of the same structure in the current single-blowing blower cannot play the role of pressurizing very well. The expected blowing efficiency is not realized compared with the single-level fan. The current dual-level or multilevel single-blowing blower has the condition that wet leaves cannot be moved by blowing or the blowing efficiency is low when in use, and the better blowing effect cannot be achieved.

In the present embodiments, as shown in FIGS. 1-4 and 11-14, the structure of the first-level fan 31 is designed to be different from the structure of the second-level fan 33. The first-level fan 31 and the second-level fan 33 comprise a hub 32 and a plurality of blades 34 disposed around the hub in a peripheral direction. When the garden blower 100 is in the working state, at least one of a rotary outer diameter of the blades, a rotary inner diameter of the blades, the number of the blades, and a dip angle of the blades of the first-level fan 31 is different from the second-level fan. It should be indicated that the level number of the fan is not limited to two, but in the present embodiment, the two-level fans are taken as an example for explanation. Further, the number of the first-level fan 31 may be 1 or more than 1, and the structures of respective first-level fans 31 may be totally same or at least partially different. Similarly, the number of the second-level fan 33 may be 1 or more than 1, and the structures of respective second-level fans 33 may be totally same or at least partially different.

The two-level fans are taken as an example to introduce that the structure of at least one level fan in the multilevel fans is different from other levels of fans in which means.

Specifically, at least one of the rotary outer diameter of the blades, the rotary inner diameter of the blades, the number of the blades, and the dip angle of the blades of the first-level fan 31 is different from the second-level fan 33. It should be noted that the blades of the fan have a wing-shaped inner chord, and an included angle between the wing-shaped inner chord and the horizontal line (frontal line) is the tip angle of the fan. That is to say, one or several or all of the four quantities (i.e., the rotary outer diameter, the rotary inner diameter, the number of the blades and the dip angle of the blades) can be changed to realize that the structure of the first-level fan 31 is different from the structure of the second-level fan 33. Specifically, examples are illustrated one by one for explanation as follows.

To be specific, the absolute value range of a difference value between the rotary outer diameter of the first-level fan 31 and the rotary outer diameter of the second-level fan 33 is 10 mm-90 mm. The absolute value of the difference value may be 10 mm, 15 mm, 20 mm, 25 mm, 35 mm, 40 mm, 45 mm, 50 mm, 55 mm, 60 mm, 65 mm, 70 mm, 80 mm and 90 mm. Further, the absolute value range of a difference value between the rotary outer diameter of the first-level fan 31 and the rotary outer diameter of the second-level fan 33 is 10 mm-50 mm.

For example, for the single-air inlet passage multilevel fan garden blower 100' (as shown in FIGS. 11-14, and specifically introduced in the second embodiment), a rotary outer diameter of the first-level fan 31 is larger than a rotary outer diameter of the second-level fan 33, 30 mm is taken as an example of the absolute value of the difference value between the rotary outer diameter of the blades of the first-level fan 31 and the rotary outer diameter of the blades of the second-level fan 33 for explanation, the rotary outer diameter of the blades of the first-level fan 31 is 110 mm, and the rotary outer diameter of the blades of the second-level fan 33 is 80 mm.

For the multilevel fan multi-air inlet passage garden blower 100 (as shown in FIGS. 1-10, and specifically introduced in the first embodiment), the rotary outer diameter of the blades of the first-level fan is 40 mm-80 mm, and the rotary outer diameter of the blades of the second-level fan is 70 mm-130 mm. Similarly, 25 mm is taken as an example of the absolute value of the difference value between the rotary outer diameter of the blades of the first-level fan 31 and the rotary outer diameter of the blades of the second-level fan 33 for explanation, the rotary outer diameter of the blades of the first-level fan 31 is 70 mm, and the rotary outer diameter of the blades of the second-level fan 33 is 95 mm.

To be specific, the absolute value of the difference value between the rotary inner diameter of the blades of the first-level fan 31 and the rotary inner diameter of the blades of the second-level fan 33 is smaller than or equal to 50 mm. The absolute value of the difference value can be 0 mm, 5 mm, 10 mm, 15 mm, 20 mm, 25 mm, 30 mm, 35 mm, 40 mm, 45 mm and 50 mm. Further, the absolute value of the difference value between the rotary inner diameter of the blades of the first-level fan 31 and the rotary inner diameter of the blades of the second-level fan 33 is 1 mm-14 mm.

For example, for the single-air inlet passage multilevel fan garden blower 100', the rotary inner diameter of the first-level fan 31 is larger than the rotary inner diameter of the second-level fan 33, and 5 mm is taken as an example of the absolute value of the difference value between the rotary inner diameter of the blades of the first-level fan 31 and the rotary inner diameter of the blades of the second-level fan 33 for explanation, the rotary inner diameter of the first-level fan 31 can be designed to be 50 mm, and the rotary inner diameter of the second-level fan 33 can be designed to be 55 mm.

For the multi-air inlet passage multilevel fan garden blower 100, the rotary inner diameter of the first-level fan is 15 mm-75 mm; and the rotary inner diameter of the second-level fan is 30 mm-100 mm. The rotary inner diameter of the 31 is smaller than the rotary inner diameter of the 33, and 5 mm is taken as an example of the absolute value of the difference value between the rotary inner diameter of the blades of the first-level fan 31 and the rotary inner diameter of the blades of the second-level fan 33 for explanation. The rotary inner diameter of the first-level fan 31 can be designed to be 50 mm, and the rotary inner diameter of the second-level fan 33 can be designed to be 55 mm.

To be specific, the difference between the number of the blades of the first-level fan 31 and the number of the blades of the second-level fan 33 is 1-9. For example, 3 is taken as an example of the difference between the number of the blades of the first-level fan 31 and the number of the blades of the second-level fan 33 for explanation. Specifically, for the single-air inlet passage multilevel fan garden blower 100', the number of the blades of the first-level fan 31 being larger than the number of the blades of the second-level fan 33 is taken as an example for explanation, the number of the blades of the first-level fan 31 is 11, and the number of the blades of the second-level fan 33 is 8. For the multi-air inlet passage multilevel fan garden blower 100, the number of the blades of the first-level fan 31 is 9, and the number of the blades of the second-level fan 33 is 12.

To be specific, the dip angle of the blades of the first-level fan 31 is different from the dip angle of the blades of the second-level fan 33. For example, the absolute value of the difference value between the dip angle of the blades of the first-level fan 31 and the dip angle of the blades of the second-level fan 33 is 1-10 degrees. For example, 3 degrees is taken as the difference between the dip angle of the blades of the first-level fan 31 and the dip angle of the blades of the second-level fan 33 for explanation. Specifically, for the single-air inlet passage multilevel fan garden blower 100', the dip angle of the blades of the first-level fan 31 being larger than the dip angle of the blades of the second-level fan 33 is taken as an example for explanation, the dip angle of the blades of the first-level fan 31 is 30 degrees, and the dip angle of the blades of the second-level fan 33 is 27 degrees. For the multi-air inlet passage multilevel fan garden blower 100, the dip angle of the blades of the first-level fan 31 is 25 degrees, and the dip angle of the blades of the second-level fan 33 is 28 degrees.

As shown in FIGS. 1, 3 and 4 and FIGS. 11-14, the above first-level fan 31 and second-level fan 33 both have an air inlet side and an air outlet side, and the air inlet sides of the first-level fan 31 and the second-level fan 33 face the same direction, and are set to face the air inlet 14. An arrangement manner of the first-level fan 31 and the second-level fan 33 is: the air inlet side of the first-level fan 31 is set to face the air inlet 14, and the air inlet side of the second-level fan 33 corresponds to the air outlet side of the first-level fan 31. The airflows enter the enclosure 10 by the air inlet 14, then enter the fan component 30 from the air inlet side, and are output from the air outlet side after being pressurized and boosted by the fan component 30. The air inlet sides of the first-level fan 31 and the second-level fan 33 face the same direction, and the working wind volume and wind pressure of the garden blower can be increased, such that the garden blower has a high wind volume and high wind speed when in work, thereby ensuring stable flowing of the airflows avoiding the impact among the airflows, and ensuring an air outlet effect of the garden blower.

Figure 11:
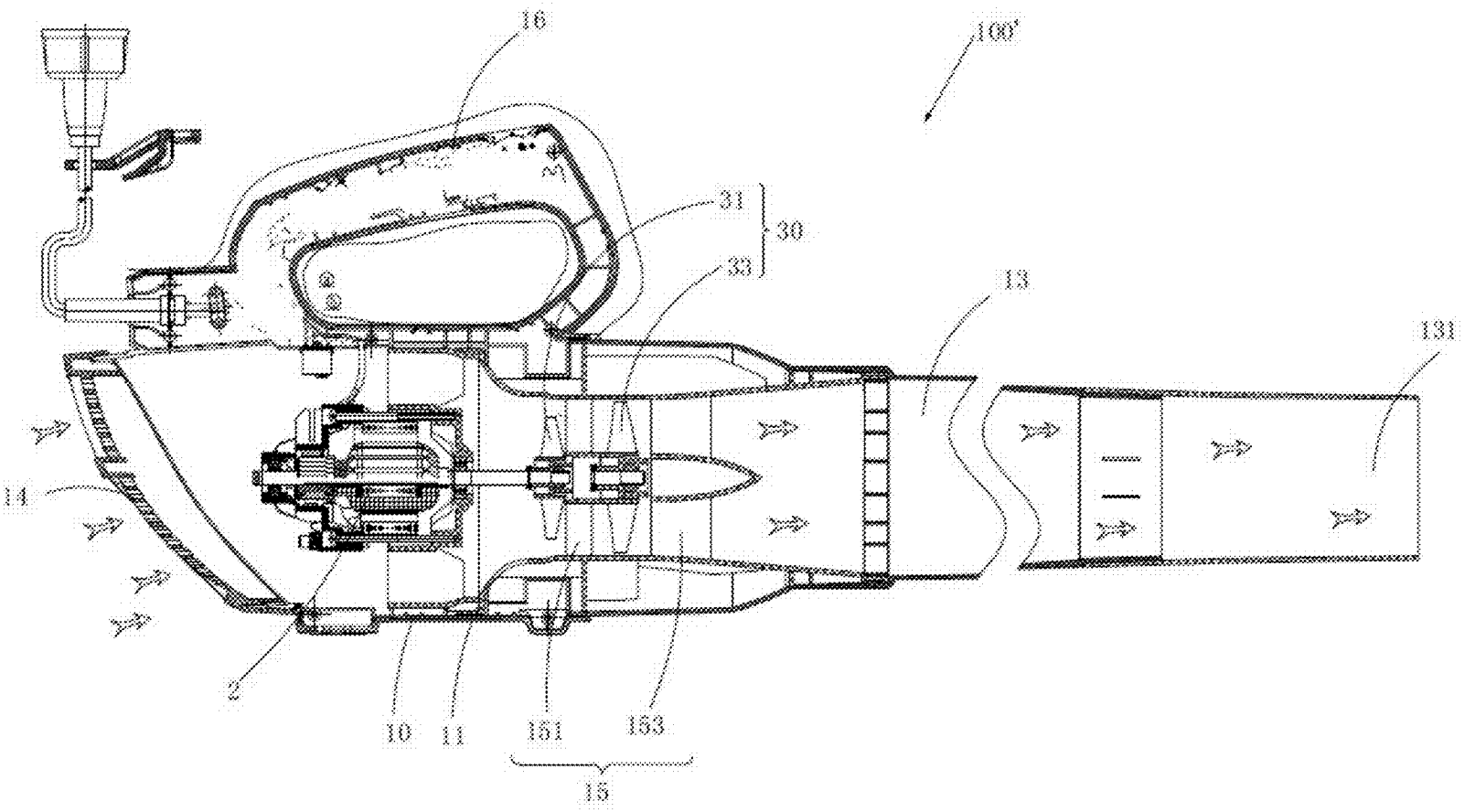
FIG. 11 is a sectional structural schematic diagram of a two-level fan single-air inlet passage garden blower according to a second embodiment of the present embodiments.
Figure 12:
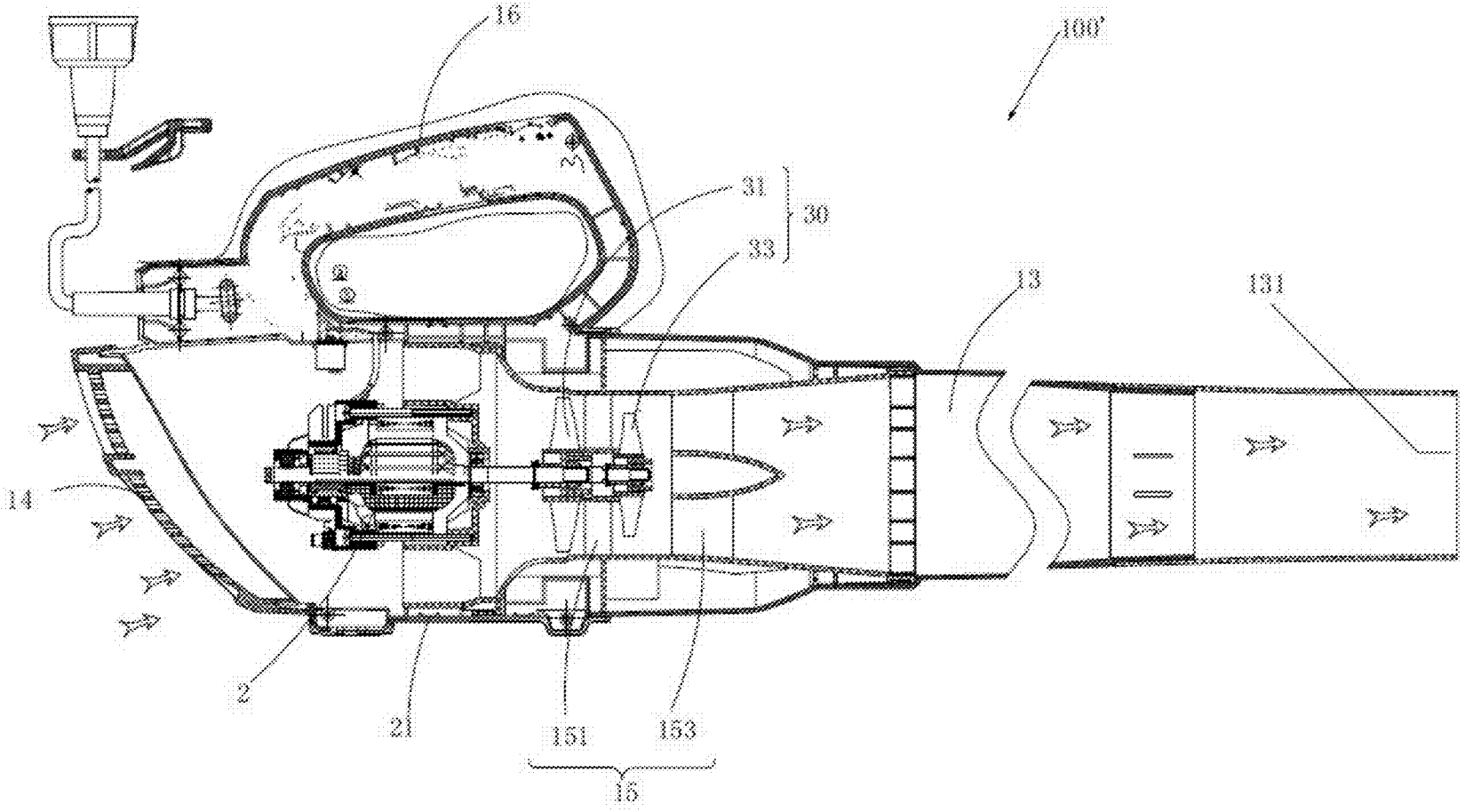
FIG. 12 is a sectional structural schematic diagram of a garden blower according to a example embodiment of the second embodiments of the present embodiments.
Figure 13:
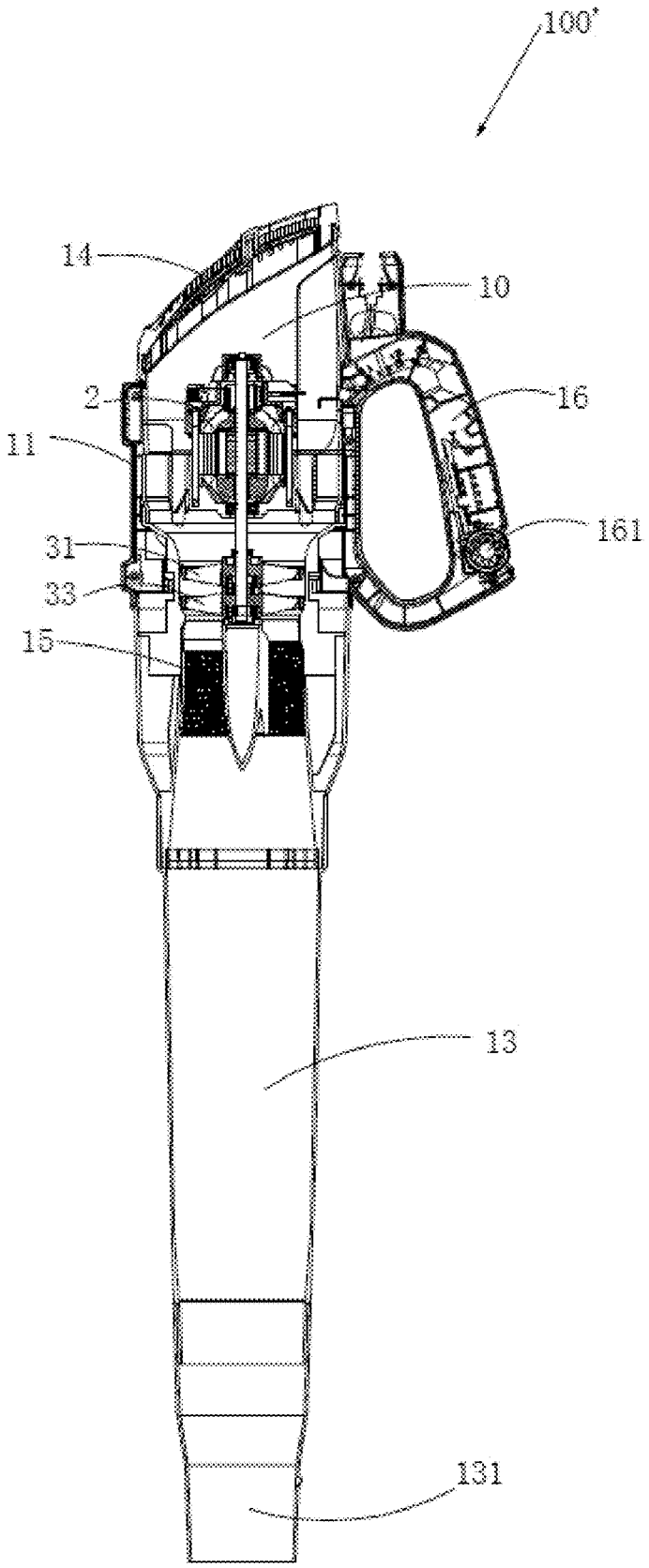
FIG. 13 is a schematic diagram of first arrangement of a guide blade in a two-level fan single-air inlet passage garden blower of the present embodiments.
Figure 14:
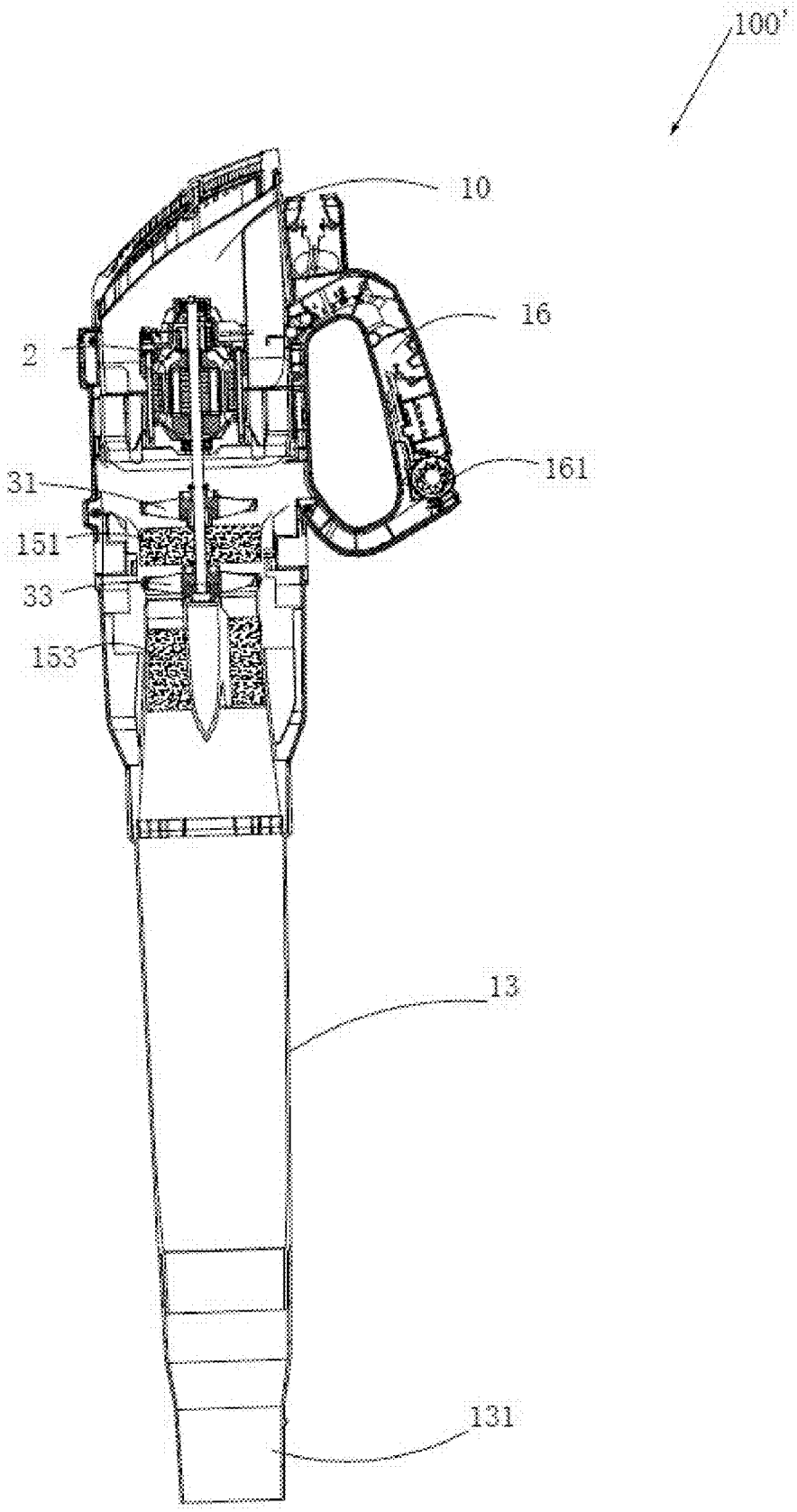
FIG. 14 is a schematic diagram of second arrangement of a guide blade in a two-level fan single-air inlet passage garden blower of the present embodiments.

The garden blower further comprises at least one level guide blade 15. Wherein the guide blade 15 can be disposed on the air outlet side of the fan component 30 (as shown in FIG. 13), and can also be disposed on one end of the air outlet side of each level fan (as shown in FIGS. 11, 12 and 14). Each level fan rotates during working to realize the pressurizing and boosting of the airflows; the guide blade 15 is motionless, the airflows output by the air outlet side are guided by the guide blade 15 to flow, such that the noise generated by the impact between the airflows and the enclosure is reduced, and the comfort level of the user during use is improved. Meanwhile, the guide blade 15 can also avoid turbulence of the airflows, ensures stable flowing of the airflows, and further ensures air outlet stability and a blowing effect.

Specifically, an arrangement mode of the guide blade is explained as follows, and as shown in FIG. 13, the fan component 30 comprises two-level fans. The level number of the guide blade 15 is one level. The first-level fan 31 and the second-level fan 33 are driven by the motor 2 to rotate, and the guide blade 15 is not disposed between the air outlet side of the first-level fan 31 and the air inlet side of the second-level fan 33, and is only disposed on the air outlet side of the second-level fans 33.

Further, another arrangement mode of the guide blade is explained as follows, as shown in FIGS. 11, 12 and 14, the fan component 30 comprises two-level fans, and the level number of the guide blades is also two. That is, the level number of the guide blades is consistent with that of the fans. Specifically, the air outlet side of the first-level fan 31 is correspondingly disposed with a first-level guide blade 151, and the air outlet side of the second-level fan 33 is correspondingly disposed with a second-level guide blade 153. Wherein the difference between the number of the first-level guide blades 151 and the number of the second-level guide blades 153 is 1-9. By taking 3 as the difference between the first-level guide blades 151 and the second-level guide blades 153, for example, the number of the first-level guide blades 151 is 3, and the number of the second-level guide blades 153 is 6. Of course, in other embodiments, the number of the first-level guide blades 151 may also be same as the number of the second-level guide blades 153.

As shown in FIGS. 1 to 4 and FIGS. 11 to 14, the garden blower is further disposed with a handle 16 for holding, and the handle is approximately shaped like a reverse C. The two ends are connected to the enclosure 10 respectively, thereby forming a holding space. Wherein the handle 16 can be integrally disposed with the enclosure 10, and may also be separately disposed with the enclosure 10. When the garden blower is operated, the handle 16 is located above the garden blower. Specifically, the handle is located above the motor 2, and in this way, the handle 16 and the motor 2 can achieve relative ideal weight balance. Further, the handle 16 is provided with an operating switch 161 for starting and closing the garden blower. The operating switch 161 may be a push button structure, and may also be in other shapes such as a columnar button, the operating switch 161 may be disposed above the handle 16, and when the operator holds the handle 16, the thumb of the operator can just touch and start the operating switch 161. The operating switch 161 may also be located on the inner side of the handle 16, such that the operator can conveniently finish the action of pressing the operating switch when holding the handle, thereby realizing fast starting or closing of the machine.

As the first embodiment of the present embodiments, as shown in FIGS. 1 to 10, the garden blower 100 rotates by the multilevel fans to generate the airflows. In the present embodiment, by taking the two-level fans as an example for explanation, that is, the first-level fan 31 and the second-level fan 33, wherein the first-level fan 31 is disposed further away from the air outlet 131 compared with the second-level fan 33. In the present embodiment, the garden blower 100 has two air inlet passages matched with the first-level fan 31 and the second-level fan 33 rather than only having the independent single-air inlet passage. The structure of the present embodiment is introduced in detail as follows.

As shown in FIG. 1, the main body part 11 and the blowing pipe 13 are disposed separately, and of course, the main body part 11 and the blowing pipe 13 may also be formed integrally. The main body part 11 is formed by assembling two half shells. Specifically, the main body part 11 comprises a left enclosure 111 and a right enclosure 113. After the left enclosure 111 and the right enclosure 113 are combined, a containing part 115 containing the motor 2 therein and an annular body part 117 forward extending from the containing part are formed. A sectional area of the annular body part 117 in a radial direction is larger than that of the containing part 115 in the radial direction.

Figure 2:
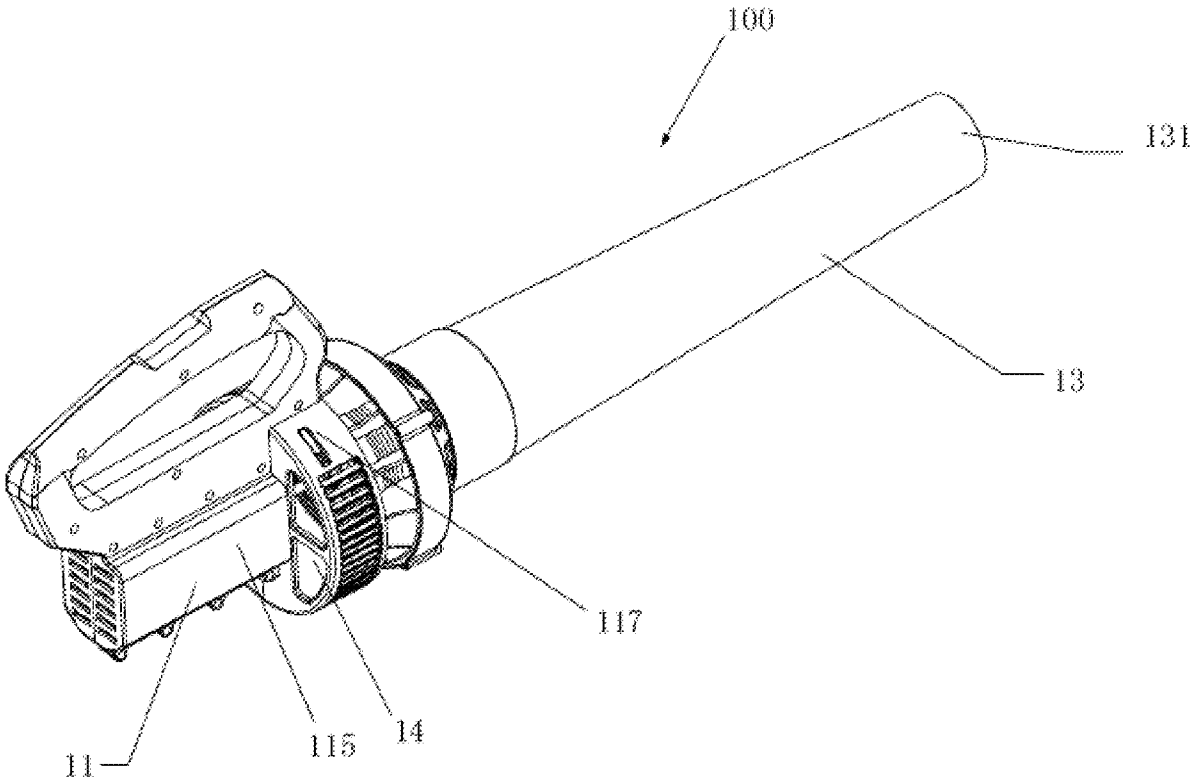
FIG. 2 is a three-dimensional constitutional diagram of the garden blower as shown in FIG. 1.
Figure 5:
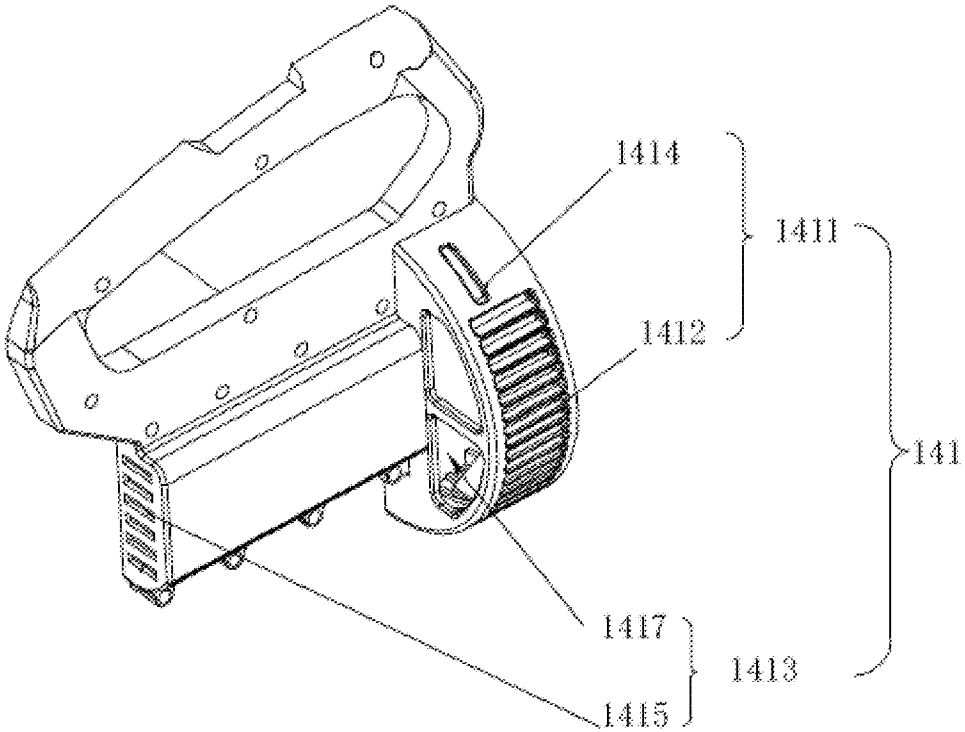
FIG. 5 is a schematic diagram of a right enclosure of the garden blower as shown in FIG. 3.
Figure 6:
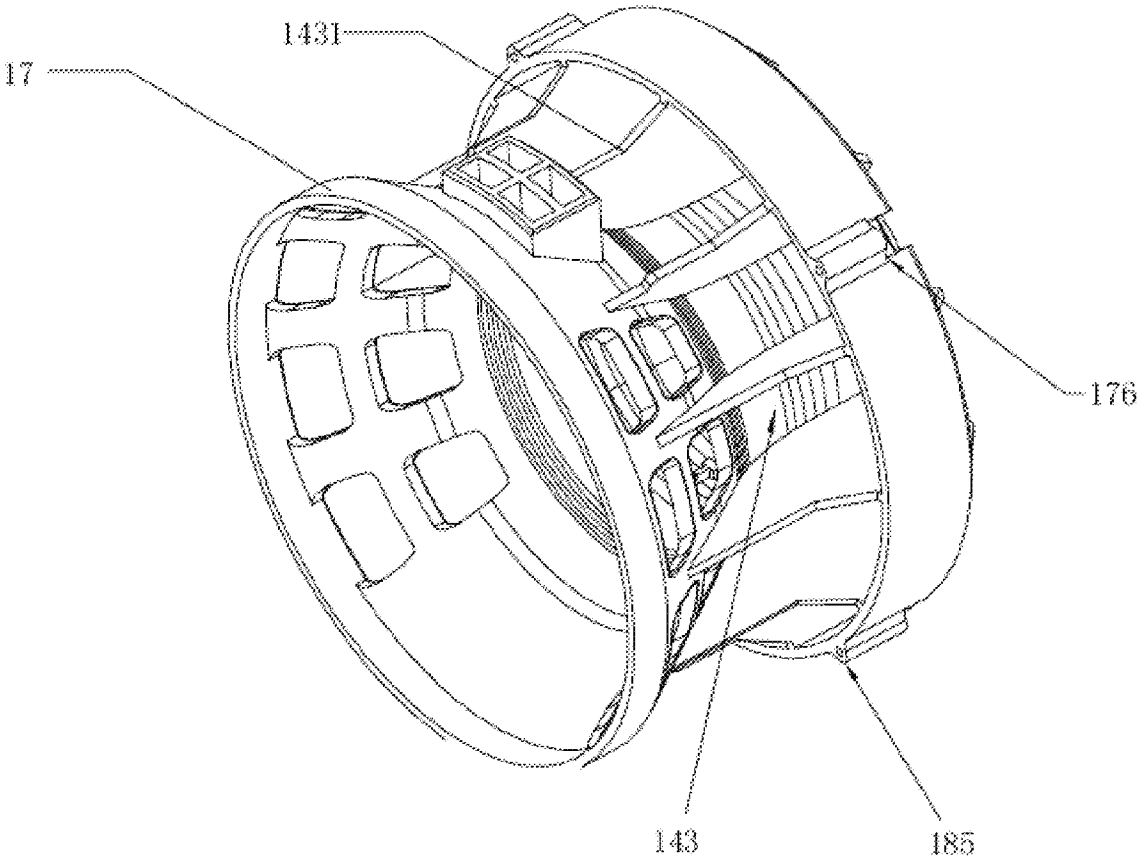
FIG. 6 is a schematic diagram of a part of structure of the garden blower as shown in FIG. 1.

As shown in FIGS. 2, 5 and 6, the air inlet 14 comprises a first group of air inlets 141 and a second group of air inlets 143 for introducing the airflows into the blowing pipe 13. The first group of air inlets 141 and the second group of air inlets 143 are both located in the back side of the fan component 30. Specifically, the first group of air inlets 141 is located in the back side of the first-level fan 31 and the second-level fan 33. The second group of air inlets 143 is also located in the back side of the first-level fan 31 and the second-level fan 33. The multiple groups of air inlets 14 are disposed to ensure the increased air inlet volume. The first group of air inlets 141 and the second group of air inlets 143 are separately and axially disposed front and back. In the present embodiment, the second group of air inlets 143 is located in an axial front end, and the first group of air inlets 141 is located in an axial back end. In order to increase the airflow inlet volume, an operation direction and an operation position of the first group of air inlets 141 are not single. Specifically, the first group of air inlets 141 comprises an axial air inlet 1411 formed in the main body part 11 and a radial air inlet 1413 annularly disposed in the peripheral direction of the main body part 11. Wherein the axial air inlet 1411 comprises a first axial air inlet 1415 formed in the containing part 115, and a second axial air inlet 1417 formed in the annular body part 117. The second axial air inlet 1417 is closer to the first-level fan 31 compared with the first axial air inlet 1415. The first axial air inlet 1415 is located right behind the motor 2, and therefore, the airflows entering the first axial air inlet 1415 not only are used for outward blowing to sweep the leaves, but also can serve as cooling airflows to directly cool the motor 2. In other words, the first axial air inlet 1415 here can also be understood as a radiating port. Wherein the radial air inlet 1413 comprises a first radial air inlet 1412 located in the annular body part 117 and extending axially, and a second radial air inlet 1414 located in the annular body part 117 and extending radially.

When the garden blower 100 is in the working state, at least part of the airflows generated by common driving of the first-level fan 31 and the second-level fan 33 enters the blowing pipe 13 from the first group of air inlets 141 and a first air inlet passage is formed between the first group of air inlets 141 and the first-level fan 31. When the garden blower 100 is in the working state, at least part of the airflows generated by single driving of the second-level fan 33 enters the blowing pipe 13 from the second group of air inlets 143 and a second air inlet passage is formed between the second group of air inlets 143 and the second-level fan 33. At least part of the airflows entering the first air inlet passage and at least part of the airflows entering the second air inlet passage are converged between the first-level fan 31 and the second-level fan 33, and are blown into the blowing pipe from the second-level fan 33. In a direction vertical to the axial direction, at least part of the second air inlet passage is annularly disposed on the periphery of at least part of a region of the first air inlet passage. It should be noted that in actual use, the airflows formed by rotation of the fans are difficult to completely flow into the blowing pipe 13 due to loss. Therefore, here it is emphasized that at least part of the airflows enters the blowing pipe 13 from the air inlet 14.

Figure 3:
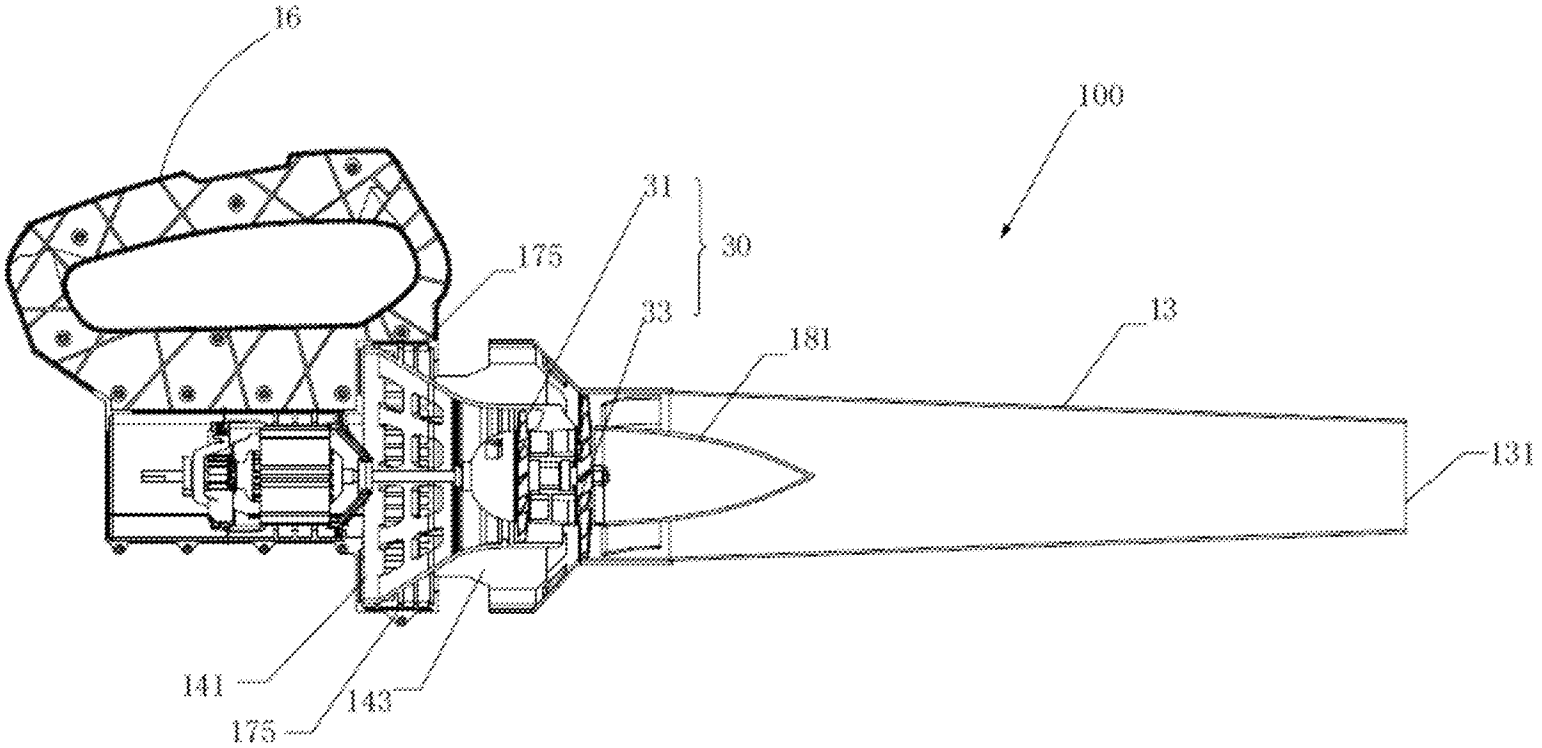
FIG. 3 is a sectional view of the garden blower as shown in FIG. 2 in a direction vertical to an axial direction.
Figure 4:
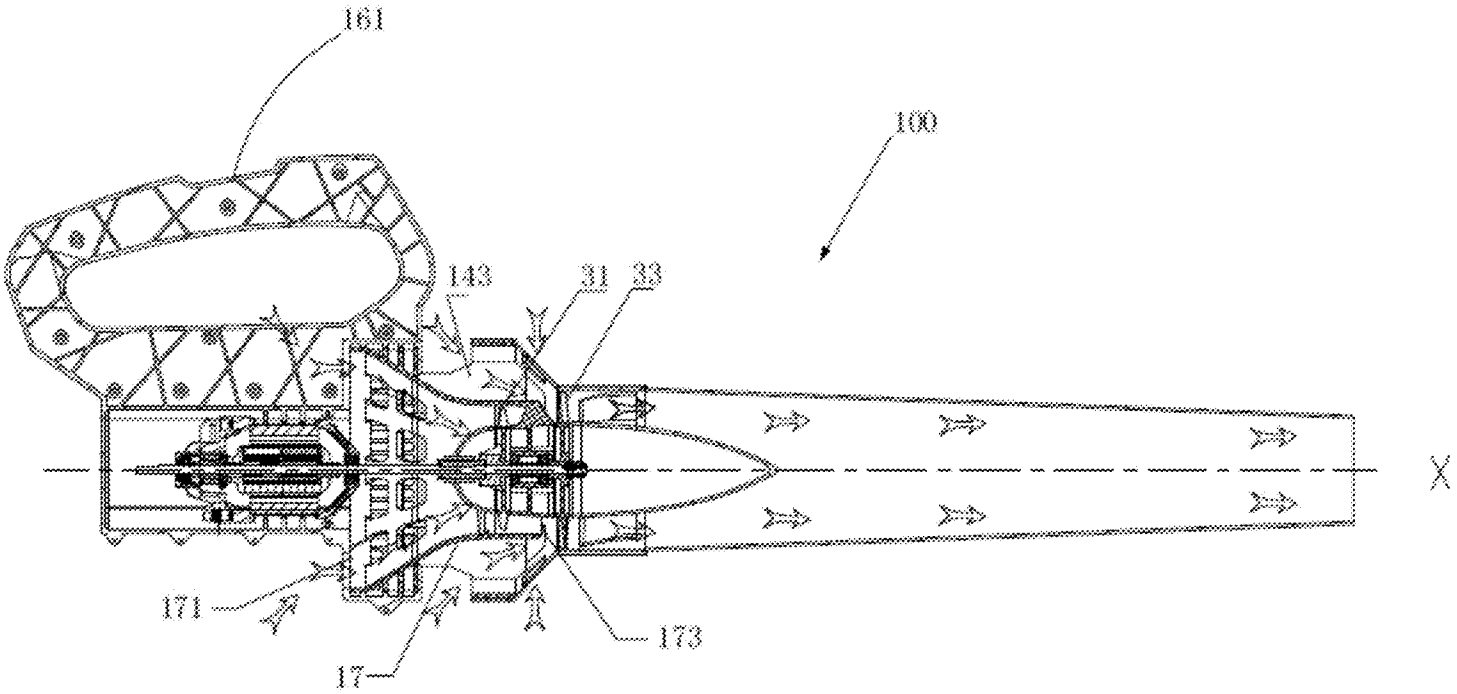
FIG. 4 is a schematic diagram of an airflow flowing direction of the garden blower as shown in FIG. 3 under a working state.

As shown in FIGS. 1, 3 and 4, the garden blower 100 further comprises a first duct part 17 guiding the airflows into the blowing pipe 13, and the first duct part 17 is located between the axial air inlet 1411 and the second-level fan 33. When the garden blower 100 is in the working state, the airflows entering from the first group of air inlets 141 at least partially flow into the blowing pipe 13 from the first duct part 17. The first-level fan 31 is disposed in the first duct part 17, and at least part of the first air inlet passage is formed in an inner cavity defined by the first duct part 17. As shown in FIG. 3, the first duct part 17 in the present embodiment is a cylindrical part, and is approximately shaped like a desk lamp. Specifically, the first duct part 17 comprises a first interface part 171 penetrating in the axial direction and a second interface part 173 opposite to the first interface part 171. The first interface part 171 is communicated with the first group of air inlets 141, the second interface part 173 is disposed between the first-level fan 31 and the second-level fan 33, and a sectional area of the second interface part 173 in a radial direction is smaller than a sectional area of the second-level fan 33 in a radial direction. That is, an opening size of the interface part is set to be small in the front and big in the back, and the airflows can be pressurized to certain extent in the first duct part 17. The back end of the first duct part 17 is fixedly connected to the main body part 11. Specifically, as shown in FIGS. 1 and 3, a vertical symmetric surface of the first duct part 17 is provided with a limiting bulge 175 to limit the first duct part 17 to rotate in a peripheral direction relative to the main body part 11.

Figure 7:
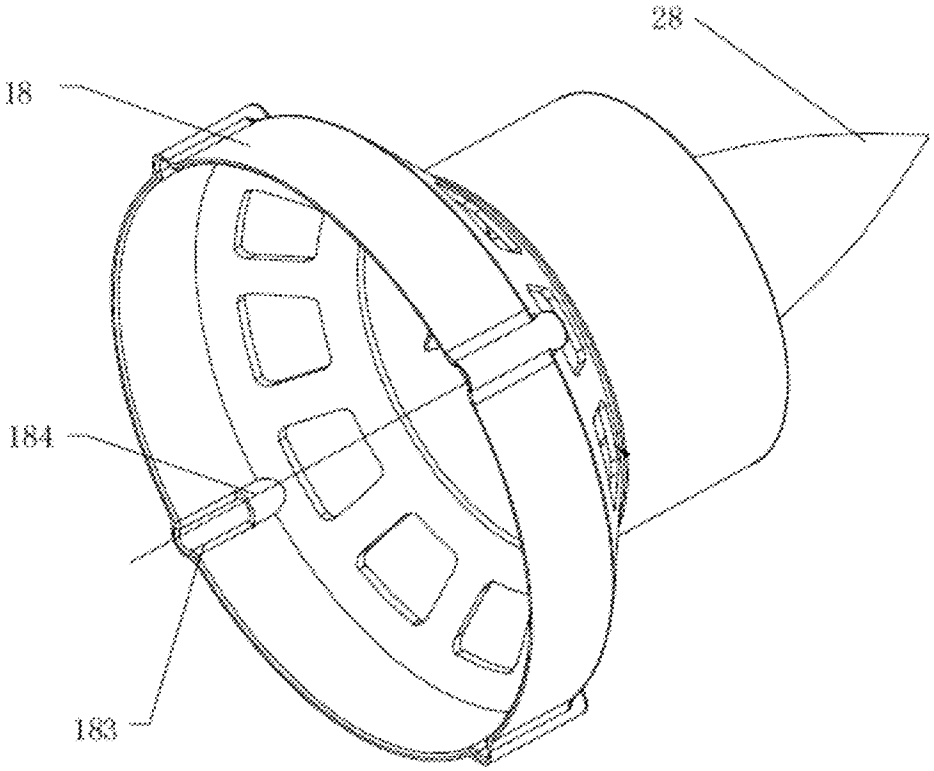
FIG. 7 is a schematic diagram of a part of structure of the garden blower as shown in FIG. 1.
Figure 8:
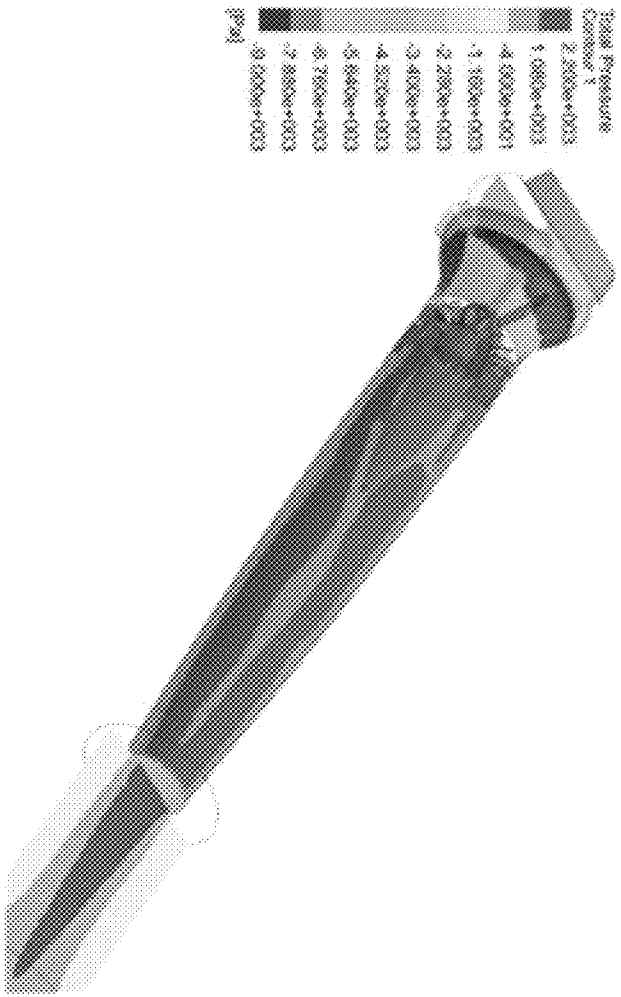
FIG. 8 is a schematic diagram of wind pressure distribution of a single-level fan single-air inlet passage garden blower.

As shown in FIGS. 1 and 3, the garden blower 100 further comprises a second duct part 18 guiding the airflows into the blowing pipe 13. When the garden blower 100 is in the working state, the airflows entering from the second group of air inlets 143 flow into the blowing pipe 13 from the second duct part 18. Wherein the second-level fan 33 is disposed in the second duct part 18, and at least part of the second air inlet passage is formed between an inner wall of the second duct part 18 and an outer wall of the first duct part 17. The second duct part 18 comprises a front guide cone 181 disposed between the fan component 30 and the air outlet 131. The sectional area of the front guide cone 181 in a direction vertical to the central axis X is gradually reduced from the axial back end to the axial front end. In order to reduce the weight and save materials, the front guide cone 181 is an internally hollow structure. In the present embodiment, due to the existence of the front guide cone 181, the sectional area of the blowing pipe in a direction vertical to the central axis X is reduced, thereby obtaining the air outlet airflows of a higher speed. The blowing pipe 13 sleeves the front end of the second duct part 18, and is detachably connected to the second duct part 18. When the garden blower 100 is in the working state, at least part of the airflows generated by single driving of the second-level fan 33 flows into the second duct part 18 from the second group of air inlets 143, and then enters the blowing pipe 13. At least part of the second duct part 18 is at least partially annularly disposed on the periphery of the first duct part 17. Wherein the first duct part 17 and the second duct part 18 are fixedly connected in a mode that a clamping pin and a clamping groove as shown in FIGS. 6 and 7 are matched and connected. Specifically, as shown in FIG. 7, the front end of the first duct part 17 is disposed with the clamping pin 176 radially bulged along the first duct part 17. As shown in FIG. 8, the second duct part 18 is disposed with the clamping groove 183 matched with the clamping pin 176, and the first duct part 17 and the second duct part 18 are fixed by clamping the clamping pin 176 into the clamping groove 183. Further, a boss 184 is disposed on the inner side of the clamping groove 183, the clamping pin 176 and the boss 184 are disposed with a threaded hole 185 respectively, and tightly connection between the first duct part 17 and the second duct part 18 is realized by threaded connection between screws and the threaded holes 185. The first duct part 17 and the second duct part 18 are connected between the blowing pipe 13 and the main body part 11. Of course, in other embodiments, the second duct part 18 may not be disposed as long as the second group of air inlets 143 allowing the airflows to enter the second air inlet passage is formed between the blowing pipe 13 and the first duct part 17, and the airflows entering from the second group of air inlets 143 may directly flow into the blowing pipe 13. Further, the number of the duct parts may not be limited to two, and the specific amount can be correspondingly adjusted according to a fan level number or the number of the air inlet passages. In the present embodiment, the first duct part 17, the second duct part 18, the main body part 11 and the blowing pipe 13 are disposed in a splitting manner. While in other embodiments, at least two of the first duct part 17, the second duct part 18, the main body part 11 and the blowing pipe 13 are integrally formed or all of them are integrally formed.

As shown in FIGS. 3, 4 and 6, the garden blower 100 further comprises a plurality of flow guide plates 1431 for guiding the airflows entering the second group of air inlets 143. The flow guide plates 1431 are disposed between an outer peripheral surface of the first duct part 17 and an inner peripheral surface of the second duct part 18 and are equidistantly disposed in the peripheral direction at an interval. The flow guide plates 1413 are disposed to guide a flowing direction of the airflows entering the second group of air inlets 143, that is, the airflows are enabled to forward axially move into the blowing pipe 13 in the second air inlet passage along the flow guide plates 1431, loss of the airflows is reduced, and air output is increased.

In the present embodiment, for the two-level fan dual-air inlet passage blower 100, the size of the first-level fan 31 is different from the size of the second-level fan 33. Specifically, a sectional area of the first-level fan 31 in a radial direction is smaller than a sectional area of the second-level fan 33 in a radial direction. A shaft power of the first-level fan 31 is smaller than a shaft power of the second-level fan 33. Further, a ratio of the shaft power of the first-level fan 31 to the shaft power of the second-level fan 33 is 1:2.5-1:1.05.

To be specific, the rotary outer diameter of the second-level fan 33 is larger than the rotary outer diameter of the first-level fan 31. Further, when the rotary speed of the motor 2 is larger than or equal to 12000 revolutions/minute, and smaller than or equal to 25000 revolutions/min, the rotary outer diameter of the first-level fan 31 is 40 mm-80 mm, and the rotary outer diameter of the second-level fan is 70 mm-130 mm. When the rotary speed of the motor is larger than 25000 revolutions/min and smaller than or equal to 100000 revolutions/min, Further, the rotary outer diameter of the first-level fan 31 is 20 mm-50 mm, and the rotary outer diameter of the second-level fan 33 is 30 mm-70 mm. The rotary inner diameter of the second-level fan 33 is larger than the rotary inner diameter of the first-level fan 31. The blades of the first-level fan 31 rotate to form a first annular rotary surface, and the blades of the second-level fan 33 rotate to form a second annular rotary surface. The sectional area of the first annular rotary surface in a radial direction is smaller than the sectional area of the second annular rotary surface in a radial direction. For example, $D_1$ is the rotary outer diameter of the first-level fan 31, $D_2$ is the hub diameter of the first-level fan 31, the sectional area of the hub in the radial direction is subtracted from the sectional area of the first-level fan 31 in the radial direction to obtain the sectional area Sa of the annular rotary surface of the first-level fan 31 in the radial direction, that is, $Sa=\pi/4\times(D_1^2-D_2^2)$. $D_3$ is the rotary outer diameter of the second-level fan 33, $D_4$ is the hub diameter of the second-level fan 33, the sectional area of the hub in the radial direction is subtracted from the sectional area of the second-level fan 33 in the radial direction to obtain the sectional area $S_b$ of the annular rotary surface of the second-level fan 33 in the radial direction, that is, $S_b=\pi/4\times(D_3^2-D_4^2)$. In the present embodiment, Sa is smaller than $S_b$.

Further, a total air inlet area formed by the first group of air inlets 141 and the second group of air inlets 143 is defined as an air inlet area. The area of the air outlet of the air outlet 131 of the blowing pipe 13 is defined as the air outlet area. In the present embodiment, Further, the air inlet area:Sb:air outlet area equals to (2-2.7):1:(0.85-1), and meanwhile, the air inlet area:Sb:air outlet area equals to (2-2.7):1:(0.85-1). Under such ratios, the blowing efficiency of the two-level fan dual-air inlet passage axial flow garden blower 100 is higher.

Further, a hub ratio of the first-level fan 31 is 0.55-0.85, and a hub ratio of the second-level fan 33 is 0.5-0.8. Further, the hub ratio of the first-level fan 31 is larger than the hub ratio of the second-level fan 33, the hub ratio of the first-level fan 31 is 0.65 Further, and the hub ratio of the second-level fan 33 is 0.55 Further. It should be noted that a root diameter of the blade 34 is the rotary inner diameter, and a top diameter of the blade 34 is the rotary outer diameter. The ratio of the hub diameter to the top diameter of the blade is the hub ratio well known by those skilled in the art. In the present embodiment, the hub ratios of the first-level fan 31 and the second-level fan 33 are very important to the wind volume and wind speed of the garden blower 100. For the axial flow garden blower 100, the hub ratio directly affects the matching between the wind volume and the wind speed, thereby ensuring the blowing efficiency of the axial flow garden blower.

As shown in FIGS. 1, 3 and 4, a transmission shaft 19 is further disposed between the motor 2 and the first-level fan 31 and the second-level fan 33. The motor 2 comprises an output shaft 31 outputting power, and the output shaft 21 drives the first-level fan 21 and the second-level fan 33 to rotate together by the transmission shaft 19 around a rotary axis. In the present embodiment, the first-level fan 31 and the second-level fan 33 synchronously operate at the same speed, but as an alternative embodiment, the first-level fan 31 and the second-level fan 33 may also synchronously operate at different speeds, or asynchronously operate at the same speed or asynchronously operate at different speeds. Further, an output shaft 21 of the motor 2 may be connected to the transmission shaft 19 by a connecting shaft bush 23, and the end part of the connecting shaft bush 23 is fixed and limited by a clamping ring 25. The connecting shaft bush 23 is disposed with a back guide cone 27; and the transmission shaft 19 penetrates through the first duct part 17 to extend into the second duct part 18. For the multilevel fan multi-air inlet passage garden blower 100, a principle for effectively improving both the wind speed and the wind volume takes two-level fan dual-air inlet passages as an example for explanation. When the garden blower 100 works, the motor 2 drives the first-level fan 31 and the second-level fan 33 to together drive external airflows to flow into the first duct part 17 from the first group of air inlets 141, at this point, a first air inlet passage is formed between the first group of air inlets 141 and the first-level fan 31, the flow flowing into the first air inlet passage is taken as Q1, and the wind pressure formed by the airflows in the first air inlet passage is taken as P1. At least part of the airflows generated by rotation of the second-level fan 33 enters the second duct part 18 to form a second air inlet passage between the second group of air inlets 143 and the second-level fan 33, the flow flowing into the second air inlet passage is taken as Q2, and the wind pressure formed by the airflows in the second air inlet passage is taken as P2. The airflows flowing into the first air inlet passage and the airflows flowing into the second air inlet passage are converged into the blowing pipe 13, that is, a mixing flow path is formed in the blowing pipe 13, and finally strong jetting airflows are formed in the air outlet 131 of the blowing pipe 13. Therefore, in the present embodiment, the wind volume Q flowing into the blowing pipe 13 equals to Q1+Q2, and the wind volume is improved greatly. The wind pressure P generated by the airflows flowing into the blowing pipe 13 equals to P1+P2. Due to the front guide cone 28, the wind pressure finally formed by the airflows on the front end of the blowing pipe 13 can be larger. Therefore, the flow rate of the airflows blown from the air outlet 131 of the bowing pipe 13 is obviously increased. Further, when the garden blower 100 is in the working state, the wind speed of the garden blower is 50-140 mph, and the wind volume of the garden blower is 250-800 cfm. According to the garden blower 100 provided by the present embodiment, it is ensured that the wind volume is obviously increased while the wind speed is considered, and due to the provided wind speed and wind volume, the garden blower can be used under different working conditions, which all have a very good blowing effect. Specifically, the increase of the wind volume and wind speed of the multilevel fan multi-air passage axial flow garden blower provided by the embodiment will be presented by comparing with the related parameters of a conventional axial flow garden blower.

Figure 9:
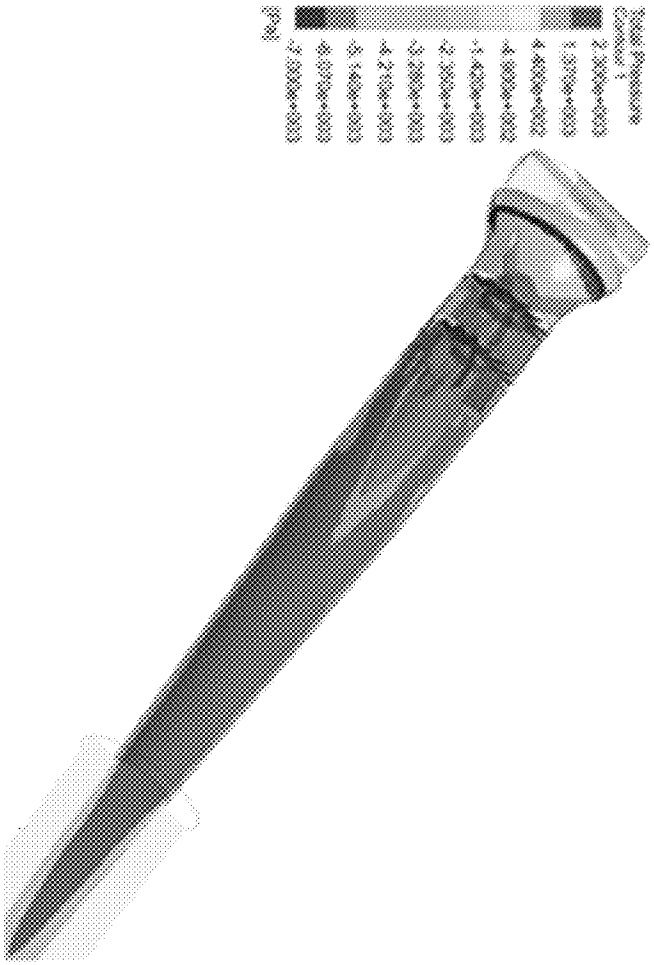
FIG. 9 is a schematic diagram of wind pressure distribution of a two-level fan single-air inlet passage garden blower.

FIG. 8 shows a schematic diagram of wind pressure distribution of a conventional single-level fan single-air passage axial flow garden blower, FIG. 9 shows a schematic diagram of wind pressure distribution of a two-level fan single-air passage axial flow garden blower, and here, the two-level fans are same in structure, and the FIG. 9 merely purely from FIG. 8 in fan superposing.

Figure 10:
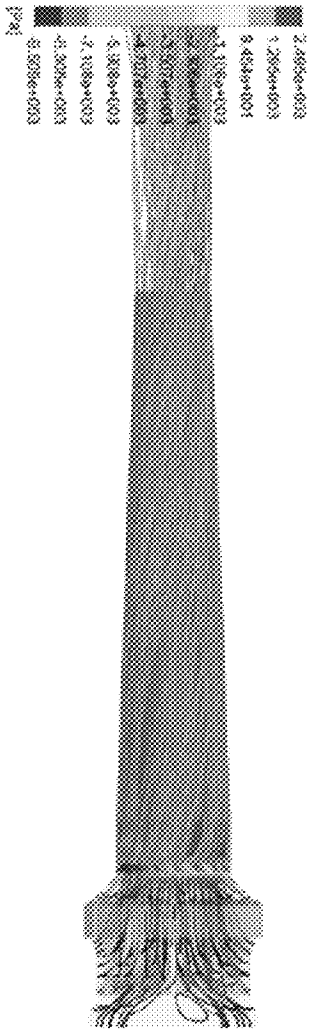
FIG. 10 is a schematic diagram of wind pressure distribution of the two-level fan dual-air inlet passage garden blower as shown in FIG. 1.

FIG. 10 is a schematic diagram of wind pressure distribution of a two-level fan dual-air inlet passage axial flow garden blower of the present embodiments. The unit of vertical axis data in FIG. 10 is pa, and represents the wind pressure of the blowing pipe in the air outlet. It is known from the following table that if the fans are purely superposed in the air passage, the pressure in the air passage is increased but the wind volume is reduced. While for the two-level fan dual-air inlet passage axial flow garden blower according to the present embodiments, in one aspect, the air inlet passages are superposed, the fan for introducing the airflows into each air inlet passage is disposed in each air inlet passage, and the first-level fan 31 and the second-level fan 33 are different in structure, such that the wind volume blown from the blowing pipe 13 is obviously increased. In the other aspect, the wind pressure is also obviously increased without changing a pipe diameter of the blowing pipe 13, further, a speed of the airflows blown from the air outlet 131 of the blowing pipe 13 is large, and the working efficiency of the garden blower 100 is obviously improved. Compared with the prior art, the improvements on the wind volume and the wind speed are both considered by the axial flow garden blower 100 of the present embodiments, and the blowing effect is very good.

The following table shows the comparison of specific parameters of two-level fan dual-air inlet passages, a two-level fan single-air inlet passage and a single-level fan and single-air inlet passage, the comparison of three machine models in such table is under the condition of the same rotary speed of the motor 2. It can be known from the following table: according to the present embodiments, by reducing the sizes of the first-level fan 31 and the second-level fan 33, the shaft power of the two-level fans is reduced, thereby reducing the power consumption of the motor 2 and the size of the whole machine also becomes more compact. By designing the structure of the first-level fan 31 to be different from the structure of the second-level fan 33, and by the design of superposing the air inlet passages, the wind volume and wind speed of the dual-fan dual-air passages are not reduced under the condition of reducing the sizes of the first-level fan 31 and the second-level fan 33. Compared with the single-fan single-air inlet passage, due to the solution of the dual-fan dual-air inlet passages are obviously improved in both wind volume and wind pressure.

| Parameters | Single-level fan single-air inlet passage | Two-level fan single-air inlet passage | Two-level fan dual-air inlet passages |
|---|---|---|---|
| Motor rotary speed: RPM | 15000.00 | 15000.00 | 15000.00 |
| Blowing capacity: g | 1360.00 | 1480.00 | 1800.00 |
| Wind volume Q: CFM | 532.00 | 529.01 | 560.00 |
| Wind pressure: pa | 2200 | 2300 | 2400 |
| Fan shaft power: w | 688.00 | 660.00 | 650.00 |
| Air outlet output power: w | 384.45 | 425.23 | 480.00 |
| Air passage efficiency | 55.9% | 64.4% | 73.8% |
| Garden blower efficiency | 45.2% | 50.0% | 56.5% |

As a second embodiment of the present embodiments, as shown in FIGS. 11-14, the garden blower 100' generates the airflows by rotation of the multilevel fans. Here, the two-level fans are taken as an example for explanation, at least part of the airflows generated by rotation of the first-level fan 31 and the second-level fan 33 enters the blowing pipe 13 from the air inlet 14, and an independent air inlet passage is formed between the air inlet 14 and the air outlet 131. The second embodiment mainly differs from the first embodiment in: the air inlet passage in the second embodiment is the single-air inlet passage. That is, the second embodiment provides the two-level fan single-air inlet passage axial flow garden blower, and of course, the structures of the two-level fans are still designed to be different. It should be noted that in actual use, the airflows formed by rotation of the fans are difficult to completely flow into the blowing pipe 13 due to loss. Therefore, it is emphasized here that at least part of airflows enters the blowing pipe 13 from the air inlet 14.

For the single-air inlet passage multilevel fan garden blower 100', the multilevel fans are different in structure, which comprises several specific conditions as follows: the shaft power of the at least two-level fans is gradually increased or gradually reduced along the axial direction or the shaft power of the at least two-level fans is irregularly changed. Level-by-level pressurizing can be realized by the above to achieve the purpose of high wind pressure and wind speed. Specific explanation is performed as follows.

As shown in FIG. 11, when the garden blower is in the working state, the shaft power of the at least two-level fans is gradually increased along the axial direction. The shaft power increased level by level may be set in arithmetic progression, and may also be set in irregular change. The two-level fans of the present embodiment are taken as an example for understanding that the size of the first-level fan 31 close to the air inlet 14 is smaller than the size of the second-level fan 33 close to the air outlet 131. Specifically, the sectional area of the first-level fan 31 in a radial direction is smaller than the sectional area of the second-level fan 33 in the radial direction. The shaft power of the first-level fan 31 is smaller than the shaft power of the second-level fan 33. A ratio of the shaft power of the first-level fan 31 to the shaft power of the second-level fan 33 is 1:2.5-1:1.05. In this way, the garden blower 100' of the present embodiments realizes level-by-level pressurizing, and the purposes of high wind pressure and high wind speed are achieved.

Or as shown in FIG. 12, as the example embodiment of the second embodiment of the present embodiments, when the garden blower 100' is in the working state, the shaft power of the at least two-level fans is gradually reduced along the axial direction. The shaft power reduced level by level may be set in arithmetic progression, and may also be set in irregular change. The two-level fans of the present embodiment are taken as an example for understanding that the size of the first-level fan 31 close to the air inlet 14 is larger than the size of the second-level fan 33 close to the air outlet 131. The shaft power of the first-level fan 31 is larger than the shaft power of the second-level fan 33. A ratio of the shaft power of the first-level fan 31 to the shaft power of the second-level fan 33 is 1.05:1-2.5:1.

In the embodiment where the shaft power of the at least two-level fans is gradually reduced along the axial direction, the blades of the first-level fan 31 rotate to form a first annular rotary surface, and the blades of the second-level fan 33 rotate to form a second annular rotary surface. A sectional area of the first annular rotary surface in a radial direction is larger than a sectional area of the second annular rotary surface in a radial direction. For example, $D_1$ is the diameter of the first-level fan 31, $D_2$ is the hub diameter of the first-level fan 31, the sectional area of the hub in the radial direction is subtracted from the sectional area of the first-level fan 31 in the radial direction to obtain the sectional area Sa' of the annular rotary surface of the first-level fan 31 in the radial direction, that is, $Sa'=\pi/4\times(D_1^2-D_2^2)$. $D_3$ is the diameter of the second-level fan 33, $D_4$ is the hub diameter of the second-level fan 33, the sectional area of the hub in the radial direction is subtracted from the sectional area of the second-level fan 33 in the radial direction to obtain the sectional area $S_b'$ of the annular rotary surface of the second-level fan 33 in the radial direction, that is, $S_b'=\pi/4\times(D_3^2-D_4^2)$. In the present embodiment, Sa' is larger than $S_b'$. Due to such design, after the airflows enter the enclosure by the air inlet 14 and make contact with the first-level fan 31 and the second-level fan 33 level by level, the wind pressure is gradually level by level, and the purpose of boosting and pressurizing level by level is realized. Besides, for the single-passage multilevel fan garden blower 100', the multilevel fans are set in a manner that the size of the fan close to the air inlet 14 is relatively larger, and a clearance between edges of the blades of the first-level fan 31 and the inner wall of the enclosure 10 containing the first-level fan 31 is larger than or equal to a clearance between edges of the blades of the second-level fan 33 and the inner wall of the enclosure 10 containing the second-level fan 33, such that the airflows pressurized by the first-level fan 31 can slowly and smoothly flow into the second-level fan 33, and the problem that after the airflows are pressurized by the first-level fan 31, the airflows are expanded between the first-level fan 31 and the second-level fan 33 to cause airflow loss is avoided. Therefore, in the present embodiment, during blowing of the garden blower 100', not only can the fan component output the high wind pressure airflows, but also the airflow loss is smaller, the blowing efficiency of the garden blower 100' is higher, and particularly for some heavy or wet leaves, the completion man hour is short and the use of the user is convenient.

Or when the number of the fan component 30 is at least three levels (not shown), wherein at least two-level fans are different in structure, further the level-by-level pressurizing is realized, and the airflows stably flow in an accelerating manner, thereby greatly reducing wind loss and power loss, and improving output power. To be specific, the shaft power of several levels of fans in the at least three levels of fans is same and larger than or smaller than the shaft power of the other levels of fans. For example, when the level number of the fan component is three levels, the structures of the two levels of fans may be set to be the same, and the shaft power of the other level of fan is set to be larger than or smaller than that of the two levels of fans. When the level number of the fan component is four levels, the structures of the two levels of fans may be set to be the same or the structures of the three levels of fans may be set to be the same, the shaft power of the rest fans may be set to be larger than that of the two or three levels of fans or the shaft power of the rest fans is set to be smaller than that of the two or three levels of fans. When the level number of the fan component is five levels or more, the setting mode is basically similar. In this way, the garden blower 100 of the present embodiments can be caused to realize the level-by-level pressurizing, and the purposes of high wind pressure and high wind speed are achieved.

By the introduction of the above embodiments, the garden blowers 100,100' disclosed in the present embodiments can meet the requirements of different working conditions. By designing the structure of the first-level fan 31 to be different from the structure of the second-level fan 33, when the garden blower blows, not only can the fan component 30 output high wind pressure airflows, but also the airflow loss is smaller, the blowing efficiency of the garden blower is higher. Particularly for some heavy or wet leaves, the completion man hour is short and the use of the user is convenient. In addition, when an area to be cleaned is larger, the working efficiency can be improved by larger wind volume. The garden blower of the present embodiments, by disposing the superposed air inlet passages (the first air inlet passage and the second air inlet passage) and disposing the fans in all air inlet passages, the wind speed and wind volume of the garden blower can be both effectively improved by the design of superposing multiple air passages and multiple fans.

Obviously, the above embodiments are merely illustrated for clear explanation instead of a limitation to the embodiments. Those ordinary skilled in the art could make other changes or transformations of other different forms based on the above explanation. There is no need or no way to illustrate all embodiments, and the obvious changes or transformations introduced therefrom are still in a protective scope of the present embodiments.

What is claimed is:

1. A garden blower, comprising:

an enclosure, comprising a main body part located on a back end and a blowing pipe located on a front end of the main body part and extending axially, the enclosure being further disposed with at least one air inlet and an air outlet communicated with an external environment;

a power device, connected to the enclosure to provide power for the garden blower;

a fan component, driven by the power device to rotate and generating airflows comprising first airflows and second airflows;

wherein the fan component comprises at least two groups of fans, the at least two groups of fans comprise a first-level fan and a second-level fan axially disposed in front of the first-level fan towards the air outlet, the garden blower comprises a first air inlet passage allowing entrance of the first airflows generated by the first-level fan and a second air inlet passage allowing entrance of the second airflows generated by the second-level fan, and the first airflows entering the first air inlet passage and the second airflows entering the second air inlet passage are converged into the blowing pipe and are blown to an outside of the blowing pipe from the air outlet;

wherein the enclosure comprises a first group of the at least one air inlet introducing the first airflows into the blowing pipe, when the garden blower is in a working state, the first airflows enter the blowing pipe from the first group of the at least one air inlet, and the first air inlet passage is formed between the first group of the at least one air inlet and the first-level fan;

wherein the enclosure further comprises a second group of the at least one air inlet allowing the second airflows to enter the blowing pipe, when the garden blower is in a working state, the second airflows enter the blowing pipe from the second group of the at least one air inlet, and the second air inlet passage is formed between the second group of the at least one air inlet and the second-level fan;

wherein the enclosure further comprises a first duct part guiding the first airflows into the blowing pipe, and when the garden blower is in the working state, the first airflows entering from the first group of the at least one air inlet flow into the blowing pipe from the first duct part, the first-level fan is disposed in the first duct part, and at least part of a region of the first air inlet passage is formed in an inner cavity defined by the first duct part;

wherein the enclosure further comprises a second duct part guiding the second airflows into the blowing pipe, and when the garden blower is in the working state, the second airflows entering from the second group of the at least one air inlet flow into the blowing pipe from the second duct part, the second-level fan is disposed in the second duct part, and at least part of a region of the second air inlet passage is formed between an inner wall of the second duct part and an outer wall of the first duct part; and wherein a front end of the first duct part is axially spaced from the second-level fan, at least part of the first airflows entering the first air inlet passage and at least part of the second airflows entering the second air inlet passage are converged between the first-level fan and the second-level fan, and blown into the blowing pipe from the second-level fan.

2. The garden blower according to claim 1, wherein the first-level fan is disposed further away from the air outlet compared with the second-level fan, and a sectional area of the first-level fan in a radial direction is smaller than a sectional area of the second-level fan in a radial direction, the first-level fan and the second-level fan are both an axial flow fan.

3. The garden blower according to claim 1, wherein the first group of the at least one air inlet and the second group of the at least one air inlet are axially separated front and back, the first group of the at least one air inlet and the second group of the at least one air inlet are both located behind the first-level fan.

4. The garden blower according to claim 1, wherein in a direction perpendicular to the axial direction, at least part of a region of the second air inlet passage is annularly disposed on the periphery of at least part of a region of the first air inlet passage.

5. The garden blower according to claim 1, wherein the first air flows entering the first air inlet passage are generated by both of the first-level fan and the second-level fan, and the second airflows entering the second air inlet passage are generated by the second-level fan only.

6. The garden blower according to claim 1, wherein the first duct part comprises a first interface part penetrating in the axial direction and a second interface part opposite to the first interface part, the first interface part is communicated with the first group of the at least one air inlet, the second interface part is disposed between the first-level fan and the second-level fan, and a sectional area of the second interface part in a radial direction is smaller than a sectional area of the second-level fan in a radial direction.

7. The garden blower according to claim 1, wherein the first-level fan and the second-level fan comprise a hub and a plurality of blades disposed around the hub in a peripheral direction, and at least one of the number of the blades, a rotary outer diameter of the blades and a rotary inner diameter of the blades of the first-level fan is different from the number of the blades, a rotary outer diameter of the blades and a rotary inner diameter of the blades of the corresponding second-level fan.

8. The garden blower according to claim 7, wherein the absolute value range of a difference value between the rotary outer diameter of the first-level fan and the rotary outer diameter of the second-level fan is 10 mm-90 mm; a difference value absolute value between the rotary inner diameter of the blades of the first-level fan and the rotary inner diameter of the blades of the second-level fan is smaller than or equal to 50 mm; a hub ratio of the first-level fan is 0.55-0.85, and a hub ratio of the second-level fan is 0.5-0.8; the difference between the number of the blades of the first-level fan and the number of the blades of the second-level fan is 1-9.

9. The garden blower according to claim 1, wherein the garden blower comprises a first-level guide blade corresponding to the first-level fan and a second-level guide blade corresponding to the second-level fan, the first-level fan and the second-level fan both have an air inlet side and an air outlet side, the first-level guide blade is located on the air outlet side of the first-level fan and the second-level guide blade is located on the air outlet side of the second-level fan.

10. The garden blower according to claim 1, wherein the power device comprises a motor, the blowing pipe is disposed with a central axis, the motor drives the first-level fan and the second-level fan to rotate around the central axis.

11. A garden blower, comprising:

an enclosure, comprising a main body part located on a back end and a blowing pipe located on a front end of the main body part and extending axially, the enclosure being further disposed with at least one air inlet and an air outlet communicated with an external environment;

a power device, connected to the enclosure to provide power for the garden blower;

a fan component, driven by the power device to rotate and generating airflows comprising first airflows and second airflows;

wherein the fan component comprises at least two groups of fans, the at least two groups of fans comprise a first-level fan and a second-level fan axially disposed in front of the first-level fan towards the air outlet, the first-level fan and the second-level fan both comprise a hub and a plurality of blades disposed around the hub in a peripheral direction, and at least one of a rotary outer diameter of the blades, a rotary inner diameter of the blades, the number of the blade and a dip angle of the blades of the first-level fan is different from the second-level fan;

a first air inlet passage allowing entrance of the first airflows generated by the first-level fan and a second air inlet passage allowing entrance of the second airflows generated by the second-level fan, and the first airflows entering the first air inlet passage and the second airflows entering the second air inlet passage are converged into the blowing pipe and are blown to an outside of the blowing pipe from the air outlet;

wherein the enclosure comprises a first group of the at least one air inlet introducing the first airflows into the blowing pipe, when the garden blower is in a working state, the first airflows enter the blowing pipe from the first group of the at least one air inlet, and the first air inlet passage is formed between the first group of the at least one air inlet and the first-level fan;

wherein the enclosure further comprises a second group of the at least one air inlet allowing the second airflows to enter the blowing pipe, when the garden blower is in a working state, the second airflows enter the blowing pipe from the second group of the at least one air inlet, and the second air inlet passage is formed between the second group of the at least one air inlet and the second-level fan;

wherein the enclosure further comprises a first duct part guiding the first airflows into the blowing pipe, and when the garden blower is in the working state, the first airflows entering from the first group of the at least one air inlet flow into the blowing pipe from the first duct part, the first-level fan is disposed in the first duct part, and at least part of a region of the first air inlet passage is formed in an inner cavity defined by the first duct part;

wherein the enclosure further comprises a second duct part guiding the second airflows into the blowing pipe, and when the garden blower is in the working state, the second airflows entering from the second group of the at least one air inlet flow into the blowing pipe from the second duct part, the second-level fan is disposed in the second duct part, and at least part of a region of the second air inlet passage is formed between an inner wall of the second duct part and an outer wall of the first duct part; and wherein a front end of the first duct part is axially spaced from the second-level fan, at least part of the first airflows entering the first air inlet passage and at least part of the second airflows entering the second air inlet passage are converged between the first-level fan and the second-level fan, and blown into the blowing pipe from the second-level fan.

* * * * *